US007973647B2

(12) United States Patent
Elberbaum

(10) Patent No.: US 7,973,647 B2
(45) Date of Patent: Jul. 5, 2011

(54) METHOD AND APPARATUS FOR REMOTELY OPERATING APPLIANCES FROM VIDEO INTERPHONES OR SHOPPING TERMINALS

(75) Inventor: David Elberbaum, Tokyo (JP)

(73) Assignee: Elbex Video Ltd., Tokyo (JP)

( * ) Notice: Subject to any disclaimer, the term of this patent is extended or adjusted under 35 U.S.C. 154(b) by 1072 days.

(21) Appl. No.: 11/509,315

(22) Filed: Aug. 24, 2006

(65) Prior Publication Data

US 2008/0068207 A1 Mar. 20, 2008

(51) Int. Cl.
*G08C 19/00* (2006.01)

(52) U.S. Cl. ..... 340/13.24; 340/13.2; 340/12.5

(58) Field of Classification Search ..... 340/825.22, 340/825.69, 825.72, 10.1, 10.2, 10.3, 10.31, 340/825.62
See application file for complete search history.

(56) References Cited

U.S. PATENT DOCUMENTS

| | | | | |
|---|---|---|---|---|
| 4,623,887 | A * | 11/1986 | Welles, II | 340/12.24 |
| 4,989,081 | A * | 1/1991 | Miyagawa et al. | 348/61 |
| 5,218,552 | A * | 6/1993 | Stirk et al. | 700/286 |
| 5,754,637 | A * | 5/1998 | Choi | 379/167.11 |
| 5,920,303 | A * | 7/1999 | Baker et al. | 345/172 |
| 5,923,363 | A | 7/1999 | Elberbaum | |
| 5,933,090 | A * | 8/1999 | Christenson | 340/12.29 |
| 6,005,508 | A * | 12/1999 | Tsui | 341/173 |
| 6,108,614 | A * | 8/2000 | Lincoln et al. | 702/183 |
| 6,133,833 | A * | 10/2000 | Sidlauskas et al. | 340/572.1 |
| 6,249,673 | B1 * | 6/2001 | Tsui | 455/92 |
| 6,353,599 | B1 * | 3/2002 | Bi et al. | 370/328 |
| 6,405,261 | B1 * | 6/2002 | Gaucher | 709/250 |
| 6,437,692 | B1 * | 8/2002 | Petite et al. | 340/540 |
| 6,535,110 | B1 * | 3/2003 | Arora et al. | 340/12.32 |
| 6,567,011 | B1 * | 5/2003 | Young et al. | 340/12.28 |
| 6,603,842 | B2 * | 8/2003 | Elberbaum | 379/106.01 |

(Continued)

FOREIGN PATENT DOCUMENTS

WO 2005125189 12/2005

OTHER PUBLICATIONS

International Preliminary Report on Patentability dated Mar. 5, 2009 and Written Opinion of the International Searching Authority dated Feb. 4, 2008, for corresponding International Application PCT/US2007/073963.

*Primary Examiner* — Daniel Wu
*Assistant Examiner* — Rufus Point
(74) *Attorney, Agent, or Firm* — Katten Muchin Rosenman LLP

(57) ABSTRACT

A method and apparatus for remotely operating at least one remote controlled appliance through a monitor station of a video interphone. The appliance itself being capable of operation by a remote control device. The monitor station includes a receiving input, a central processing unit, a memory, select keys and at least one output. The remote control device is used for generating a coded signal to the receiving input which filters the received coded signal for feeding a clean envelope of the coded signal to the central processing unit. The central processing unit processes the envelope and generates counted data pertaining to the envelope and indexes and stores the counted data into the memory. One of the select keys is assigned for retrieving and feeding the counted data to the output on the basis of the indexing. The output regenerates the coded signal for operating the appliance.

32 Claims, 10 Drawing Sheets

U.S. PATENT DOCUMENTS 6,940,957 B2 * 9/2005 Elberbaum ..... 379/106.01
7,046,185 B2 * 5/2006 Griesau et al. ..... 341/176
7,154,566 B2 * 12/2006 Gustafson et al. ..... 348/734
7,290,702 B2 * 11/2007 Elberbaum ..... 235/380
7,319,978 B2 * 1/2008 Minamishin et al. ..... 705/26.81
7,461,012 B2 12/2008 Elberbaum
7,586,398 B2 * 9/2009 Huang et al. ..... 340/10.5
2001/0025349 A1 * 9/2001 Sharood et al. ..... 713/340
2006/0012489 A1 * 1/2006 Yokota et al. ..... 340/825.72
2006/0019679 A1 * 1/2006 Rappaport et al. ..... 455/456.5

* cited by examiner

Principle Data bit waveform for OOK (ON/OFF) modulation

Principle Data transmission for FSK (FM) modulation

Principle Data transmission for ASK (AM) modulation

Typical TTL high/low data bit waveform used for access control

Typical TTL high/low data bit waveform used with OOK transmitter

Typical data bit waveform used with FM-O modulation

METHOD AND APPARATUS FOR REMOTELY OPERATING APPLIANCES FROM VIDEO INTERPHONES OR SHOPPING TERMINALS

BACKGROUND OF THE INVENTION

1. Field of the Invention

This invention is related to video interphone system and to wired or wireless control, including IR and RF, used for remotely operating electrical devices and appliances.

2. Description of the Prior Art

Wired or wireless remote control devices including Infra-Red (IR) or RF transmitter for remotely operating electrical appliances such as television receivers, DVD or VCR recorders, audio players, air conditioners, motorized curtains, lighting and other electrical appliances in homes and apartments employ serial or other coding that are configured for operating only with a specific appliance, manufactured by a specific manufacturer. The problem is that each manufacturer of a given appliance uses proprietary technologies for the remote controlling of the appliance with randomly selected frequencies, bandwidth, clocks, signal levels, signal polarities, modulation, protocols and coding techniques, all of which makes the remote control of appliances by different manufacturers incompatible. This prevents the use of a remote control panel for a mixture of appliances and/or systems produced by different manufacturers. The result is that control panels, including panels that employ the well known IR or RF remote control signals for a specific appliance cannot be used with other appliances that are installed in the same house or apartment. This state impedes the advances in home automation, the concept of which is the controlling of different appliances from the same control panel. Current home automation systems therefore mandate the use of interfaces, relay boxes and extensive re-programming of control panels for the integration of different appliances into home automation control system, which is complicated, time consuming and costly. Such a method and apparatus for utilizing unknown remote control signal for integrating remote control keys with video interphone system is also disclosed in U.S. application Ser. No. 11/024,233 dated Dec. 28, 2004.

SUMMARY OF THE INVENTION

It is an object of the present invention to provide for a method and apparatus for recording the original control codes and signals generated by the remote control devices of the different appliances for integrating the recorded codes and signals into the control panels of video interphones and "shopping terminals" for generating the control codes and signals from the control panels to the different appliances through a driver circuits including at least one driver selected from a group consisting of wireless driver, RF driver, IR driver, bluetooth driver, data driver, hard wired driver, relay driver and a combination thereof for operating electrical appliances including appliances selected from a group consisting of home theater, television receiver, A/V appliances, audio and video players and recorders, BGM (back ground music), radio, clock radio, air conditioners, heaters, lighting devices, light controllers, light switches, electrical shades and curtains, elevator, kitchen appliances, bathroom appliances, garden appliances and a combination thereof. "Shopping terminals" are disclosed in U.S. application Ser. No. 10/864,311 dated Jun. 8, 2004 and PCT international application PCT/US05/19564 dated Jun. 3, 2005 for method and apparatus for simplified e-commerce shopping via home shopping terminals. Video interphones systems are disclosed in U.S. Pat Nos. 5,923,363, 6,603,842 and 6,940,957.

Another object of the present invention is to provide for a method and apparatus for recording and utilizing unknown coded signals selected from a group consisting of serial coded signal, parallel coded signal, data signals, hard wired contact signals, alarm signals, home sensors signals and a combination thereof for re-generating said coded signal through said driver for operating said electrical appliances.

The apparatus for utilizing unknown remote control signals and other objects of the present invention are attained by using one or more RF receivers for receiving one or more specific or broadband frequencies that are approved by the authorities, such as FCC approval of unlicensed frequencies within the USA. The unlicensed frequencies are the well known frequencies used for remote control devices or alarm devices, identified as specific frequencies of 308.825 MHz, 315 MHz, 418 MHz, 433 MHz, 914 MHz and 916.5 MHz, or as 308~315 MHz band, 415~435 MHz band and 913~918 MHz band.

It is possible to use a single broad band receiver for covering the entire 300 MHz up to 950 MHz range, but in practice it is preferable to use at least two separate receivers for receiving the RF signals generated by any remote control devices, one receiver covers the 300~450 MHz band and the second covers the 900~930 band. Because of the very low RF power transmission permitted by FCC it is preferable to use three receivers, one for the 308~315 MHz band, the second for 415~435 MHz band and the third covering the 913~918 MHz band. If more bands or specific accurate receivers for specific frequencies are needed, any number of matching receivers can be added and used.

It is also possible to provide a sweep frequency receiver covering the entire range of 300 MHz up to 950 MHz, controlled by a CPU by detecting the frequency of a signal generated by RF remote control device, and by locking the oscillator frequency of the receiver to a frequency commensurating with the detected frequency of the received signal. As will be explained later, by such arrangement the CPU can also control the frequency of an RF driver for regenerating RF remote control signals to a selected appliance.

Each of the receivers includes receiving antenna and a demodulator for demodulating the received signals. Each demodulator includes well known circuits that are designed for demodulating on-off keying, known as OOK modulation, amplitude shift keying, known as ASK or AM modulation and frequency shift keying, known as FSK or FM modulation.

The well known demodulator circuits can be demodulators that are incorporated in the well known single package receiver ICs that are commercially available at low cost, or they can be made by standard well known circuit components, such as transistors, diodes, filters, coils and other well known components and designed to accommodate and demodulate an OOK, ASK, AM, FSK or FM modulated signal.

Hence, the first step of the method for utilizing unknown remote control signals is to receive said unknown remote control signals through said at least one receiver and demodulate the received signals on the basis of a modulation selected from a group consisting of OOK, ASK, AM, FSK or FM modulation.

The method and apparatus for utilizing unknown remote control signal of the present invention applies to IR remote control signals the same way it applies to the RF remote control signals. For this purpose at least one IR receiver comprising IR filter, lens and photo sensing diode, along with demodulator and processing circuit are incorporated in the apparatus for utilizing unknown remote control signals. The demodulator for demodulating and processing the received IR signals is similar to said RF demodulator and processor. The commonly used demodulator circuit of such IR receiver is OOK type because the commonly used IR remote control devices are operated on the basis of on-off keying, but any other IR modulation and demodulation circuits can be employed, including AM and FSK modulation.

The wavelength of an IR generated signals for remote control devices ranges from 950 nm to 850 nm and employ mostly a clock frequency of 38.5 KHz with some remote control devices employing clock frequency of up to 500 KHz. A single IR receiver covering the wide IR range of 950 nm~850 nm and beyond can be used for receiving and demodulating the OOK modulated remote control signals. In practice the IR receiver is available in a single low cost package and includes the receiving and demodulating circuits.

The demodulated signal is a low frequency envelope of the original encoded transmission, generated by the remote control panel or device. The envelope signal is outputted from the demodulator through a well known Low Pass Filter, known as LPF, that allows the low frequency of the envelope to pass and blocks the high frequency carrier and/or high frequency noises from the output signals. By this the demodulated output or the envelope signal is reproduced into clean envelope of the original code generated by a given remote control device, such as RF or IR key and which consist mostly of serial digital code, also well known as protocol.

The demodulated envelope signal can be further processed by a well known digital circuits such as digital signal amplifier for amplifying the signals to an over size signal, a well known clipper circuit and a clamping circuit for clipping the signal to its specified level and for clamping the envelope lows or highs to a selected reference, thereby providing clean envelope signal with sharper edges, noise free and with correct levels. Further, the envelope signal can be reversed by a well-known inverter circuit for unifying the polarities of the envelope signals of the different remote control devices.

The demodulated and processed envelope signal is fed to a gating input of a counter and to an input of a CPU. Many different well known counters and counting methods can be used for utilizing the unknown remote control signals of the present invention, and moreover many of the current well known CPUs, such as the well known microprocessors that are commercially available at low cost, incorporate counting and timing circuits, thereby providing for connecting and feeding the envelope signal directly to the CPU, making the counter as a separate circuit unnecessary and not used, which is the preferred embodiment of this invention. However for clarification the counter is explained below as a separate circuit.

The counter is fed via the CPU with high frequency clock, for example 50 MHz, by this the counting error of a single pulse width and/or the fall or rise time during the counting of the envelope is reduced to units of 0.02 μsec or 20 nsec duration, which are insignificant time units for the low frequencies of the unknown remote control signals that are ranging from 10 Hz and up to 500 KHz.

The counter is an up-down counter with a separate preset output and is gated by the envelop signal such that a pulse rise resets the counter to zero and starts the up counting, while a pulse fall also resets the counter to zero but starts the down counting. The counter outputs to the CPU a positive counted number for the duration of the highs of the envelope and a negative counted number for the duration of the lows of the envelope. The CPU that also reads directly the inputted envelope can therefore record the duration of each individual high and low of the envelop signal, the number of highs and lows, the total lows, the total highs, the total length and the total sum pertaining the unknown coded signal as represented by the envelope. Considering the example of the 50 MHz clock, the accuracy of the counting will be ±20 nsec units of time.

Accordingly, the second step of the method for recording and utilizing unknown coded signals is to feed the envelope of the demodulated signal to a counter of a CPU for counting the content of said unknown envelope, selected from a group consisting of the duration of each high and each low states, the sequence of each high and each low, the total number of highs and lows, the total lows duration and total highs duration, the total sum, the total length (intime) of the envelope and the polarity of the envelope and a combination thereof.

The counted values of said unknown envelope of an unknown remote control signal are recorded by storing the counting details into a memory and utilizing the recording of said unknown coded envelope for accessing and controlling said appliances and/or systems on the basis of the recorded details of said remote control signals. The recording also include such details as listing the particulars of each remote control devices, its different keys and functions and other details pertaining the appliance and its location in the house or the apartment along with index or protocol for the recalling of each individual control code for regenerating the control signals for operating said appliance.

The third step of the method for utilizing unknown remote control signals is therefore, the storing and indexing of the counted values of said envelope into a memory.

The steps of counting, storing and indexing unknown envelop signal generated by an RF or IR remote control device also applies to an unknown reader output signal such as card or proximity reader used in elevator, or for directly fed serial or parallel code signals, all of which can be processed and their envelopes counted, stored and indexed the same way as described for the envelopes of the received RF or IR signals.

Remote control devices, including such devices as magnetic card or a barcode card, are configured to transmit or to generate via their corresponding readers respectively a complete, whole code. Some types of remote control devices are configured to repeat the transmission of the serial coded signal, others transmit the complete serial code once per each touch of a key. However all the remote control devices transmit a complete coded signal, which commonly starts with a pilot bit, sync bit and/or start bit and ends with an end bit.

The commonly used receivers, readers and the processors for the remote control devices and/or the magnetic, proximity and other keys or cards are pre configured to read and accept only incoming coded signals that precisely match the pre configured codes, the timing of the pulses, the pulses duration and the precise start bit, the address data, command data and other exclusively configured programs to ensure that only an exclusive pre configured and pre programmed match can access the appliance and/or the system.

In contrast, the present invention provides for the use of any such remote control devices, including such devices as magnetic cards, barcodes, proximity keys and other access devices by recording the details of their code's envelop, which represents very accurately the remote control device's complete unknown coded signals, including such pulse items as pilot, sync, start bit and end bit, all of which become leading pulses and ending pulses within the unknown recorded signals, stored and indexed into said memory.

Therefore, for the counting process of the present invention there is no specific need for pilot bit, sync bit or start bit to initiate the counting process, and the counter starts its counting whenever its gate input is fed with a rise or a fall in the envelope signal fed to it. For ending the counting and/or for completing the counting process of the received signal the counter is programmed to reset itself and stop counting whenever the high or low state remains for a longer duration than "n" milli seconds.

The resetting of the counter also provides for resetting the system's CPU into its receiving state and for enabling the receiving of a freshly transmitted signal. It is simple to configure the "n" duration, for example, when the slowest rate of the unknown code signal is 1 kbit/sec the width of each low and/or high state of the envelope signal cannot practically exceed 1 milli second duration, therefore "n" duration of longer than, for example, 10 milli second or 100 milli seconds can be safely configured as an error free end of the transmission.

Accordingly, the next step of the method for recording and utilizing unknown coded signal is therefore the resetting of the counter and the CPU to their "receiving ready" state whenever the duration of any of the low or the high states of the envelope signal is longer than a preprogrammed "n" time duration.

It is preferable that the CPU is provided with sequencing codes recording, such that a remote control device provided with multiple alphanumeric keys for keying a programmed password can be used. A limitation for multiple keying of unknown coded signals will therefore be the time spacing between the keying, which must be longer than said "n" time duration. As the "n" time duration can be a fraction of a second, such as between 10 milli second and 100 milli second, such short time duration does not prevent in any practical way the multiple keying of a password via said keys and the recording of said remote control device's password by the CPU.

The sequence of the keying of a password, for recalling an elevator as an example, the envelope counted values of the four digits in sequence, such as 3-1-4-2 are recorded individually one after another into the memory, for which the CPU is programmed to process the four separate envelopes in the recording sequence and as will be explained later, as programmed, while operating the home automation functions.

The method and the apparatus of the present invention provides for connecting buffer circuits or modules that can be installed anywhere in the house or the apartment or in the vicinity of the appliances for generating wireless, IR, RF, bluetooth, wired data, wired relay contacts and a combination thereof for remotely operating the electrical appliances by generating coded signals from the video interphone and/or the shopping terminals panels or devices, on the basis of the recorded and indexed commands stored in said memory, which can be programmed for automatic or manual activation and processed by said CPU. The video interphone and/or the shopping terminal's monitor can display the different controls for the different appliances for recalling each function independently via touch keys, or for recalling plurality of programmed preset functions, such as "day preset" for a programmed and selected home appliance's functions in the morning or for a programmed and selected evening presets for home appliance's functions in the evening, etc.

BRIEF DESCRIPTION OF THE DRAWINGS

The foregoing and other objects and features of the present invention will become apparent from the following description of preferred embodiments of the invention with reference to the accompanying drawings, in which.

DETAILED DESCRIPTION OF THE PREFERRED EMBODIMENTS

Figure 1:
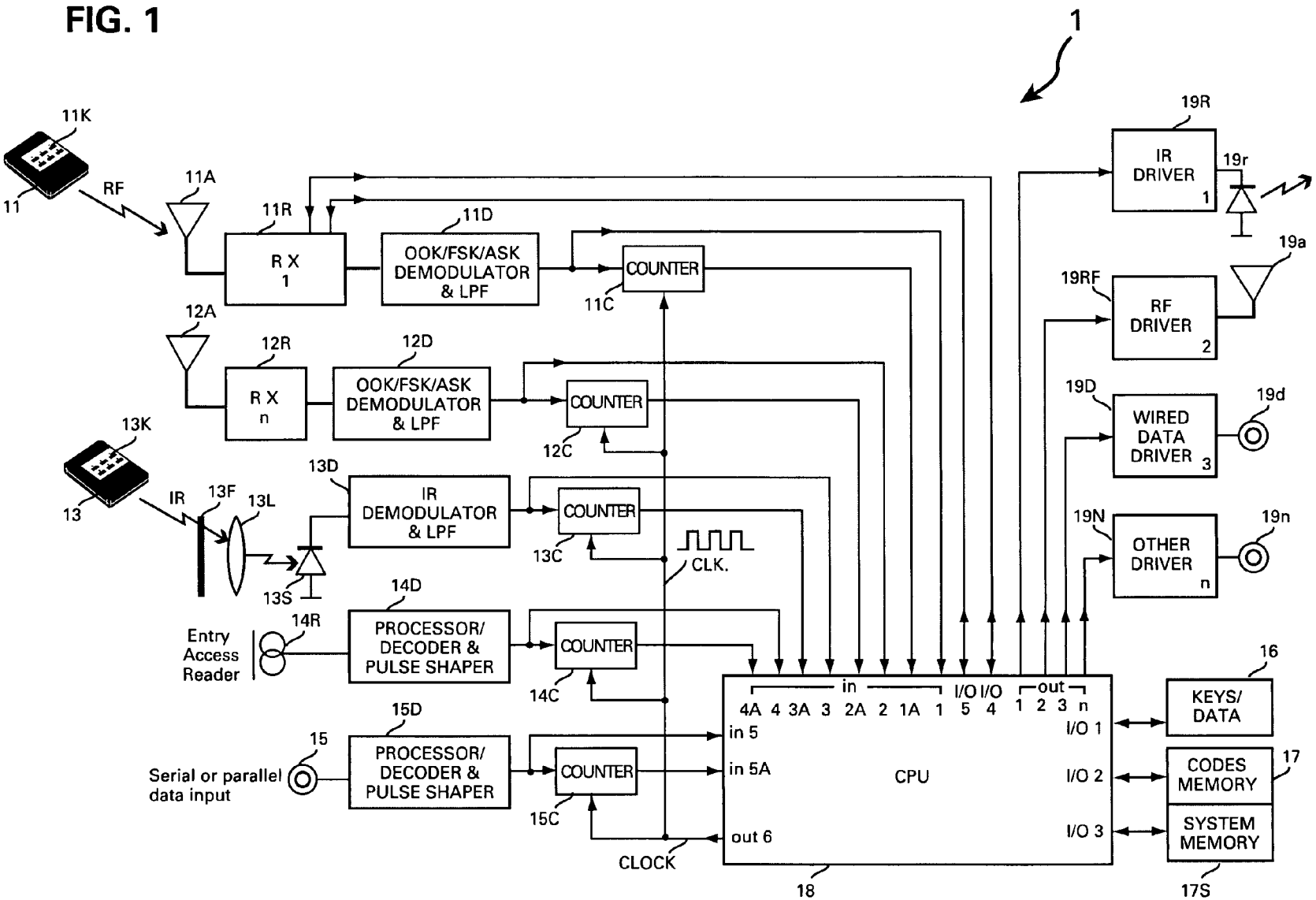
FIG. 1 is an electrical block diagram of the apparatus for recording and utilizing unknown coded signals of the present invention.

Shown in FIG. 1 is the apparatus 1 for recording and utilizing unknown signals of remote control devices such as RF remote control 11, IR remote control 13, an access reader 14R and an input 15 for a serial or parallel data. The apparatus 1 includes n number of RF receivers shown in FIG. 1 as 11R and 12R, each of said receivers is connected to a receiving antenna 11A and 12A and to a demodulator circuit 11D and 12D respectively. Each of the demodulator output is fed to a counter 11C and 12C and to a respective input 1 and 2 of the CPU 18. The CPU 18 is connected through its I/O 2 and I/O 3 terminals to a memory 17 and 17S for recording counted data of unknown signals generated by said remote control devices and by said access reader 14R and said data through said input 15, as well as to record information pertaining the appliances, the remote control devices, the system operation and its parameters.

The CPU 18 is further connected to the control circuit 16, which is an internal circuit of the CPU 18, but shown in FIG. 1 as a separate circuit and to the control keys 16. The control keys 16 are used for processing the recording of the unknown coded signals and for entering data pertaining the remote control device and the respective remote controlled appliance, its location and function and any other details needed to operate the appliance. The keys 16 can also be used to setup the functions of the apparatus 1 that may be connected to a given system such as video interphone system shown in FIG. 7, to a shopping terminal shown in FIG. 8 or to a home control system (not shown). The control keys 16 can be a well-known ASCII keyboard such as used for PC, or it can be a set of push, touch, touch screen or other keys of the apparatus 1.

The CPU 18 is further connected to "n" drivers shown as 19R, 19RF, 19D and 19N for providing driver outputs fed through terminals out 1~n of the CPU. The driver output 19*r*, 19*a*, 19*d* and 19*n* can be wireless, IR or a relay output, alternatively the driver circuit can be a buffer amplifier for outputting serial or parallel coded command for recalling elevators or for arming or disarming alarm or emergency devices and systems and/or for switching on or off lighting system or operating A/V and similar appliances.

Each of the outputs of the demodulators 11D and 12D is connected individually to a gated input of a respective counter 11C and 12C for counting a clock fed from the output terminal 1C of the CPU 18 to the clock input of the counters 11C and 12C.

The counters 11C and 12C are up-down counters with a separate preset output and are gated by the envelope signals fed from the demodulators 11D and 12D. The up-down counting is set by the rise and the fall time of the gate signal, wherein a pulse rise resets the counter to zero and starts the up counting, while a pulse fall also resets the counter to zero but starts the down counting.

The receivers 11R and 12R are well known receivers in the UHF band, that are commonly available in a single chip IC at low cost, and include the demodulator circuit 11D and 12D that are shown in FIG. 1 as a separate demodulator and LPF circuit. The receiver RX1 11R and RXn 12R are n number of receivers to cover any number of specific frequencies and or bands within the permissible spectrum of the UHF band. The frequencies used for remote control devices and for short distance data communication are known in the USA as unlicensed frequencies, approved by FCC and are identified as specific frequencies of 308.825 MHz, 315 MHz, 418 MHz, 433 MHz, 914 MHz and 916.5 MHz, or as 303~315 MHz band, 415~435 MHz band and 913~918 MHz band. Though these frequencies are freely available, the FCC attaches very stringent limits, governing the transmission power to a maximum of micro watts and milli watt levels.

This mandates very sensitive receivers, which means, tuned receivers with narrow bandwidth for improving the signal to noise ratio. Other radio frequencies in the Giga Hertz range of 2.4 GH and the like, or any other frequencies such as used with wireless keyboards for PC, Bluetooth or Wi-Fi can be used instead.

It is possible to use single broadband receiver to cover the entire UHF spectrum of 300 MHz~950 MHz range or any other spectrum range, but such wide band receiver cannot have good signal to noise ratio for the very low signals generated by the remote control devices.

Therefore, to obtain better reception and to improve upon the signal to noise ratio of the receivers it is advisable to use in the USA at least two receivers one covering the 300 MHz~450 MHz band and the other covering the 900 MHz~930 MHz band. The preferable setup will be three receivers, the first for 308 MHz~315 MHz, the second for 415 MHz~435 MHz and the third for 913 MHz~918 MHz. Such narrow bands can provide high sensitivity and low noise reception and due to the very low cost of such single chip receiver IC, the including of three receivers or more such as one for each specific frequency is very cost performance effective.

Another method employing a broadband receiver, for covering the entire UHF spectrum, particularly the three ranges of the unlicensed frequencies of 308~315 MHz, 415~435 MHz and 913~918 MHz, is to provide a frequency scanning receiver, incorporating variable and/or step oscillator circuit and a signal level measuring circuit including such a circuit as analog to digital converter incorporated into the CPU 18 or 18A for measuring the transmitted RF signal level and a counter for measuring the transmitted frequency. With such a scanning receiver, it is possible to automatically or manually activate the scanning circuit by generating remote control command through the remote control key 11K of the wireless remote control device 11. The scanning can be made also in three independent steps, covering the three frequency ranges of 308~315 MHz, 415~435 MHz and 913~918 MHz.

Shown in FIG. 1 the RX1 11R is fed with scan control line through the I/O 4 port of the CPU 18 and feeds back a level reference signal and frequency readout to I/O 5 port of the CPU 18. With this scanning receiver it is possible to have one receiver that covers any of the unlicensed frequencies and at a workable signal to noise ratios. Further since the recording of the unknown remote control device's signals can be executed with the remote control device positioned at a close distance to the receiver or its antenna such as 10 cm (4") or even shorter distance, a broad band receiver or a scanning receiver is a very practical solution for receiving, processing and recording the unknown wireless coded signals.

Another advantages of a scanned frequency receiver are the use of the frequency readout for controlling of the frequency of the regenerated wireless command by the RF driver 19RF. Using variable frequency transmitter the RF driver 19RF can be commanded to transmit different frequencies, identical to the frequency received by the RX1 receiver 11R from each individual wireless remote control device 11, of each individual appliance.

Each of the shown receivers RX1 11R and RXn 12R are connected to an individual antenna 11A and 12A respectively and because commonly the antenna's length is equal to ¼ or ⅛ of the wave length, they can be a line or a loop designed onto the printed circuit board of the apparatus 1, with literal insignificant cost in production.

The demodulators 11D and 12D shown in FIG. 1 as a separate circuit include well known circuits that are designed for demodulation on-off keying, known as OOK modulation, amplitude shift keying, known as ASK or AM modulation and frequency shift keying, known as FSK or FM modulation.

Figure 4A:
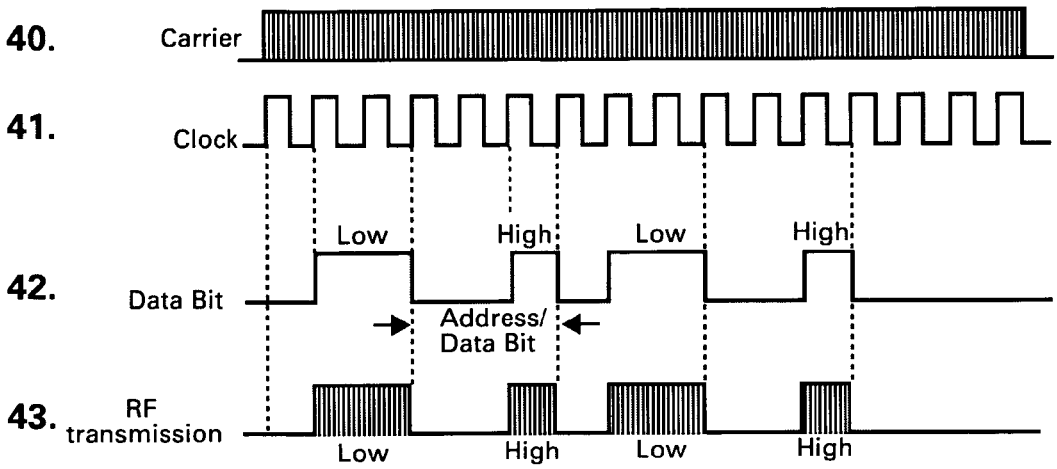
FIGS. 4A~4C are waveforms processed and transmitted by the well known RF remote control devices.

Shown in FIG. 4A is a typical OOK modulation waveform known as On-Off Keying. The carrier signal 40 is keyed on and off by the data bit pulses 42 comprising narrow pulses for high state and wide pulses for low state, however the width of the pulses can be reversed. The narrow and the wide pulses are generated on the basis of integer number of clock pulses 41, such as one clock width is high and two clock width is low, as shown in the waveform 42. The data bit pulses key on and off the carrier 40 to transmit coded RF signal shown in waveform 43.

Figure 4B:
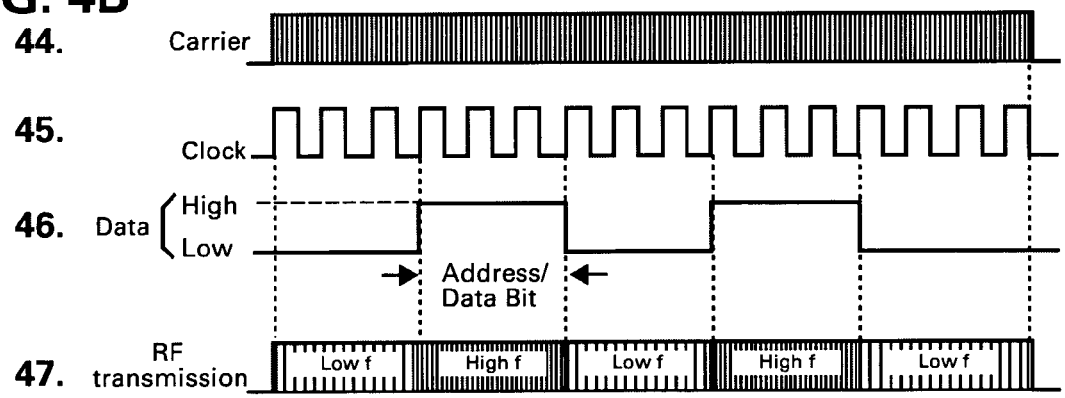

FIG. 4B shows a typical wave form of FSK or FM modulation known as Frequency Shift Keying. The frequency of the carrier signal 44 is shown as the high state frequency of the RF transmission shown in the waveform 47. The data shown in waveform 46 is the high-low level data of the commonly known digital data. Here too the data is synchronized with the clock 45 for keying synchronously the carrier to shift the frequency to a low state. The high and the low state of the carrier frequencies can be high frequency for high and low frequency for low, as shown in waveform 47, but the frequencies can be reversed. The difference between the FM and FSK modulation is the range of shifting frequencies, wherein FM provide for varying frequency change and the FSK is limited to the switching over of two frequencies.

Figure 4C:
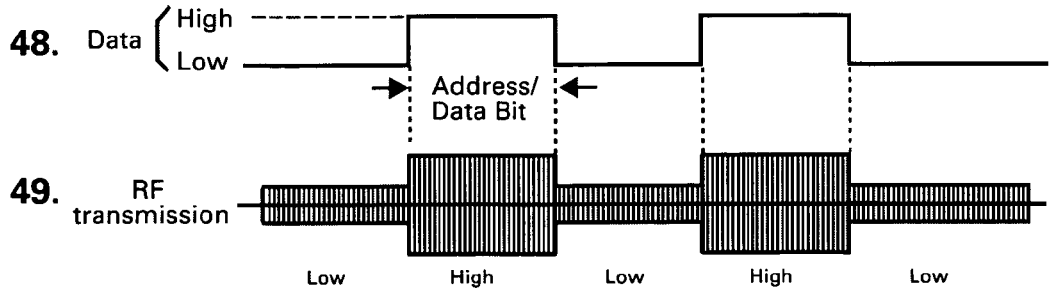

FIG. 4C shows typical waveforms of ASK and AM modulation, known as Amplitude Shift keying. The carrier of FIG. 4C is the same carrier shown in waveform 44 and the data waveform 48 is the same data shown in the waveform 46. The RF transmission shown in waveform 49 is typical well known dual side band amplitude modulation, and in practice the ASK uses the well known single side band amplitude modulation. Here too the difference between the ASK and AM modulation is the varying levels of amplitude modulation and the fixed two levels for ASK modulation. Also, though the High bit data 48 shows high carrier level 49 and Low bit data 48 is transmitted as low level carrier 49, this can be reversed as well.

The pulse durations of the lows and highs of the waveforms 46 and 48 are shown with identical time duration for the high and low data, however the pulse duration or the pulse width commonly used for FSK, FM, ASK and AM modulations are the data bit shown in 42.

The RF transmitters for generating waveforms such as shown in FIGS. 4A, 4B and 4C used for the remote control devices 11 of FIG. 1 are commonly available in a single package ICs at low cost, or are made by standard well known circuit components, such as transistors, diodes, filters, coils and other known electric components.

Figure 3:
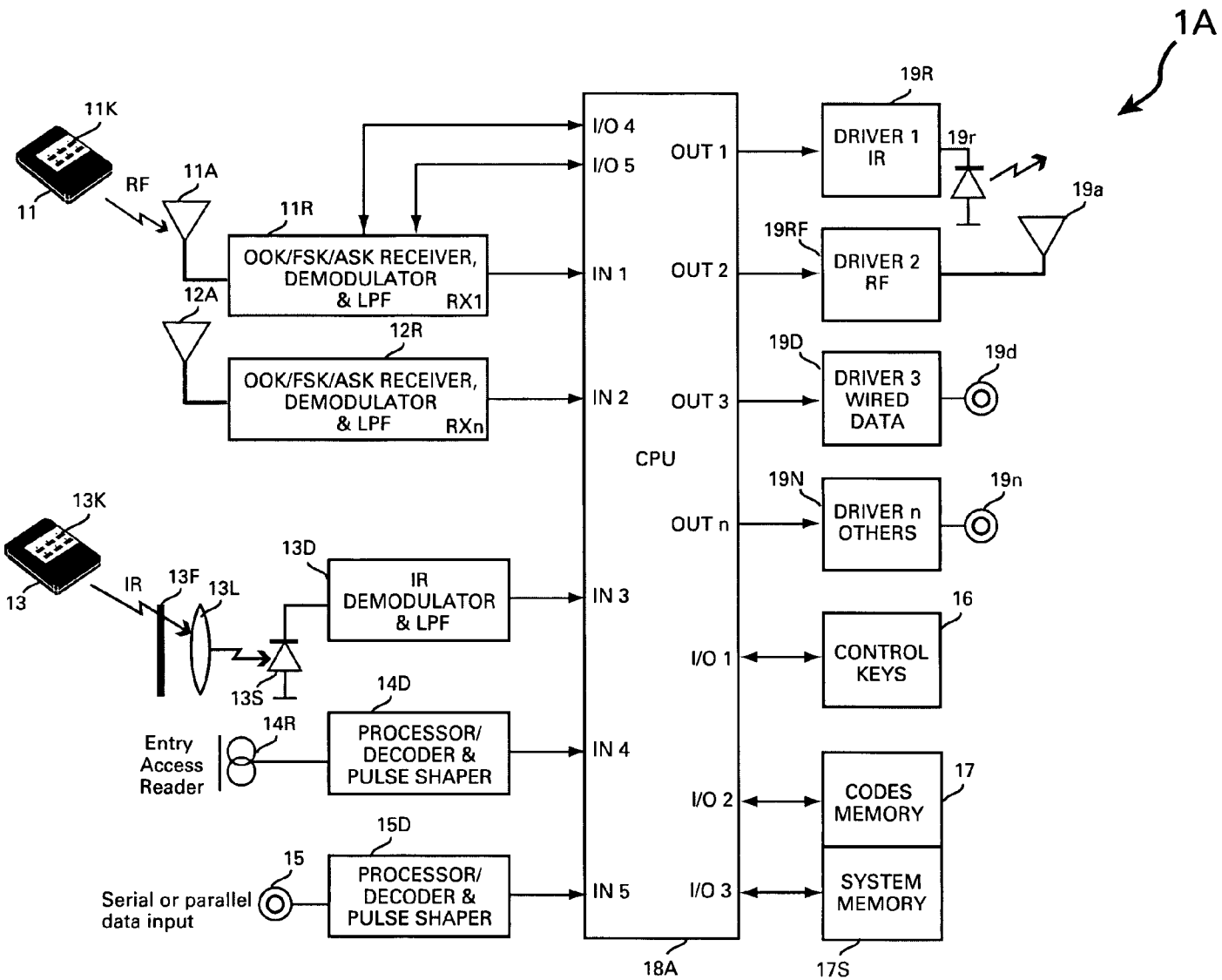
FIG. 3 is an electrical block diagram of the preferred embodiment of the apparatus for recording and utilizing unknown coded signals of the present invention.

Similarly, the well known single package receiver ICs shown in FIG. 3 as RX1 11R and RXn 12R include the demodulator circuit 11D and 12D of FIG. 1 and are commercially available at low cost. Otherwise, the demodulators such as 11D and 12D can be made by standard well known circuit components, such as transistors, diodes, filters, coils and other known electric components and designed to accommodate and demodulate an OOK, ASK, AM, FSK or FM modulated signal.

The remote control device 11 is activated by a push or touch key 11K for transmitting a serially coded RF modulated signal. The serial code for modulating the RF signal or the encoding signal is a low frequency signal, having baud rate in a range of up to 1 kbit/sec. The commonly used remote control devices 11 will transmit the whole code at least once per each touch of the key 11K and the transmitted RF signal is received by the receiver 11R or 12R through its antenna 11A or 12A. The receiver output signal is fed to the demodulator 11D or 12D respectively for demodulating and filtering the signal.

The demodulated filtered signal is a low frequency envelope of the original encoded transmission, generated by the remote control device 11. The envelope signal is outputted from the demodulator through a well known Low Pass Filter 27B, known as LPF shown in FIG. 2C, that allows the low frequency of the envelope to pass and blocks the high frequency carrier and/or the high frequency noises from the output signals, by this the demodulated filtered output or the envelope signal is reproduced into clean envelope of the original code generated by a given remote control device 11.

Figure 2A:
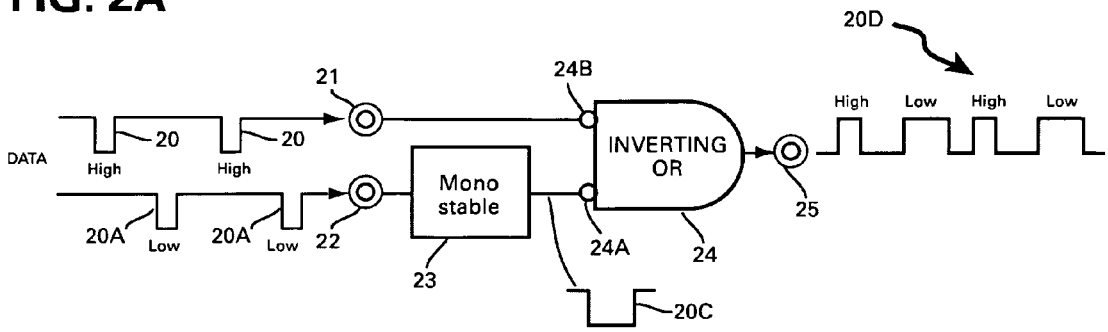
FIGS. 2A~2D are electrical block diagrams of typical digital and data signal processing, shaping, converting and counting for use with the apparatus of the present invention.
Figure 2B:
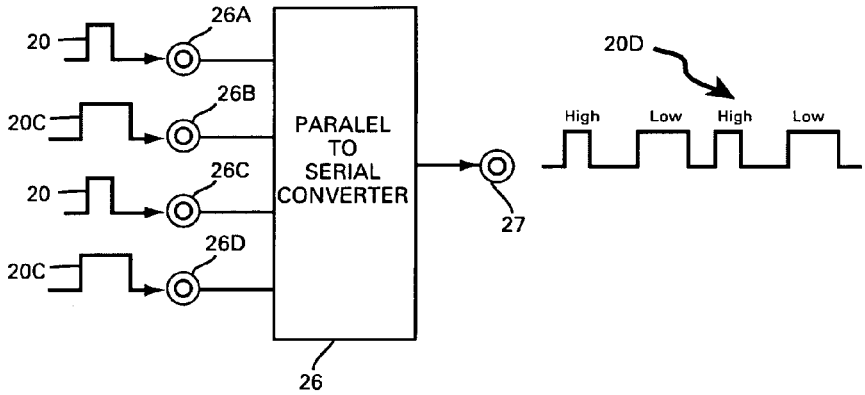
Figure 2C:
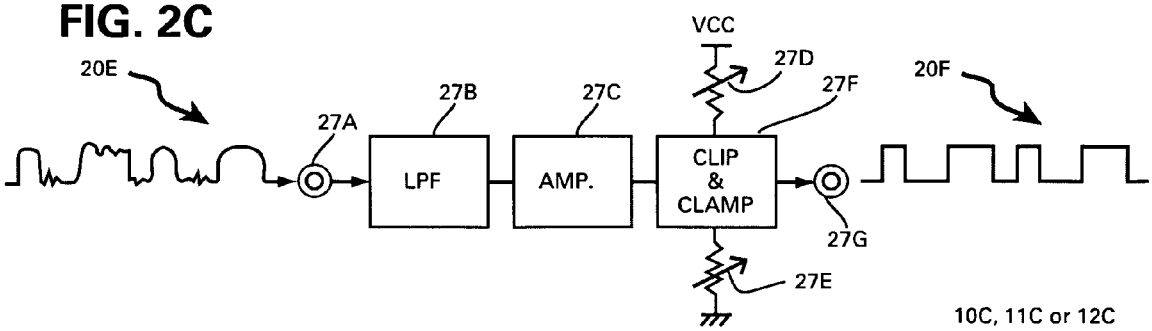

The filtered envelope signal can be further processed by a well known digital circuits such as digital signal amplifier 27C shown in FIG. 2C for amplifying the signals to an over size signal, a well known clipper circuit and a clamping circuit 27F for clipping the signal to its specified level and for clamping the envelope lows or highs to a selected references, selected through, for example, the potentiometers 27D and/or 27E shown in FIG. 2C, thereby providing a clean envelope signal 20F with sharper edges, noise free and with specified levels and clamped. Further, the envelope signal can be reversed by a well-known inverter circuit such as the inverting gate 24 shown in FIG. 2A, for unifying the polarities of the envelope signals of the different remote control devices 11, even though such unified polarities are not necessary for the recording and utilizing unknown coded signals of the present invention.

Figure 6A:
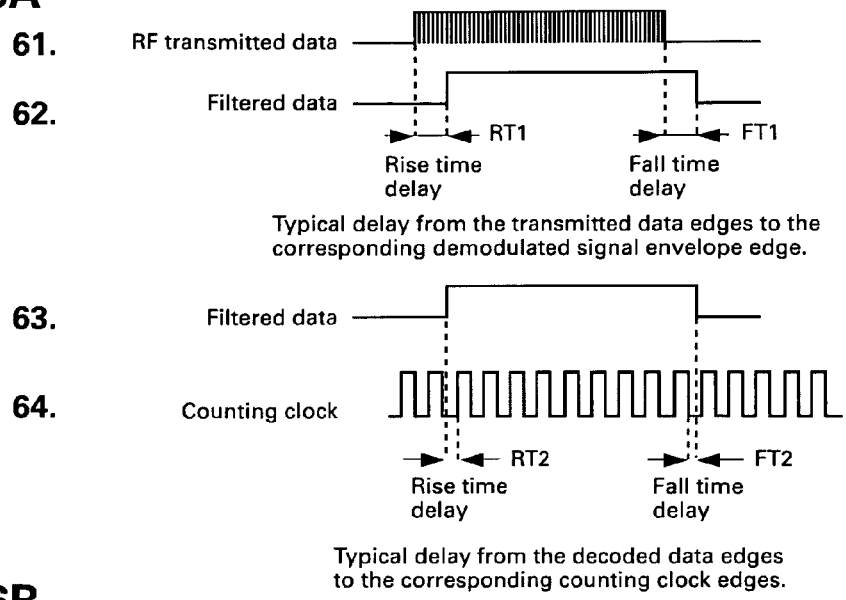
FIGS. 6A and 6B are waveforms showing the rise and fall time errors of a demodulated envelope signal and of the counting errors of a clock gated by the demodulated envelope.

There is a timing error in the rise and fall times of each individual pulse of the filtered envelope because of the signal processing delay, shown in FIG. 6A. The timing of the rise and fall of the envelope signal 61 shows a time delay of RT1 and FT1 versus the rise and fall time of the received RF signal 61, however the time errors are repetitious, and as will be explained later, because the errors are repetitious they present no errors for the recording and the utilization of unknown coded signals of the present invention.

Figure 2D:
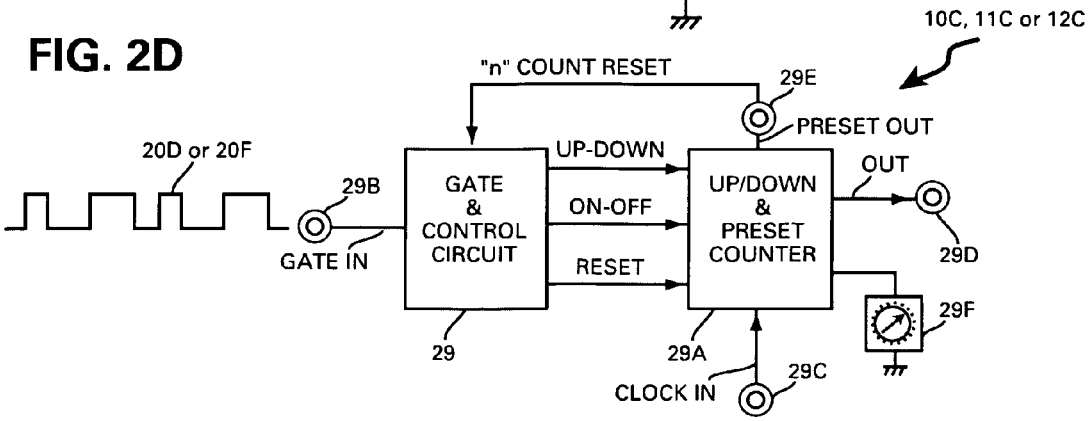

The envelope signal 20D or 20F is fed to a gate input 29B of a counter 11C or 12C shown in FIG. 2D and to an input 1A or 2A of the CPU 18. Many different well known counters and counting methods can be used for recording and utilizing the unknown coded signals, and moreover many of the current well known CPUs that are commercially available at low cost incorporate counting and timing circuits, thereby providing for connecting and feeding the envelope signal directly to the CPU, making the counters 11C and 12C as a separate circuit unnecessary and not used, which is the preferred embodiment of this invention as shown in FIG. 3. However for clarification the counter is explained below as a separate circuit.

The counting input 29C of the counter is fed with high frequency clock outputted from the CPU out 6 terminal, for example 100 MHz, by this the counting error of a single pulse width of the unknown coded envelope and/or the fall or rise time during the counting of the envelope is reduced to units of 0.01 μsec or 10 nsec, which are insignificant time units for the low frequencies of the unknown coded signals that may range from 200 Hz and up to 50 kHz.

Shown in FIG. 6A is the filtered data envelope 63, which gates the counter 11C or 12C for counting the clock 64. As shown in FIG. 6A the rise and fall timing errors between the non synchronous envelope 63 and the clock signal 64 are RT2 and FT2, however since the timing errors cannot exceed the time duration of for example 10 nsec of the example clock frequency of 100 MHz, such timing errors of less than 10 nsec are wholly insignificant for the accuracy of the counting process and its influence on the utilization of the unknown coded signals generated by said remote control devices.

Figure 6B:
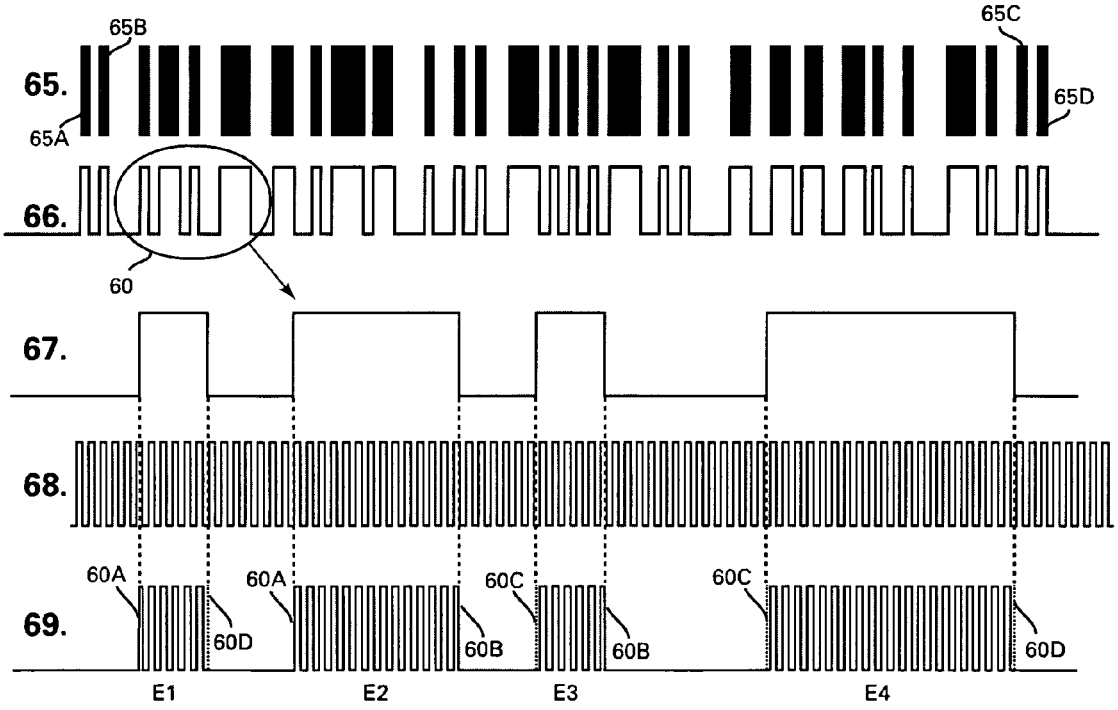

The portion 60 of the envelope 66 of the barcode 65 shown in FIG. 6B is expanded for showing the details of the counting errors associated with the rise and fall times. The envelope 67, which is the expanded waveform of the portion 60, is the gating signal for the counter 11C, 12C, 13C, 14C or 15C. The clock 68 is the clock fed to the counter's clocking input of FIG. 2D and which is non synchronized with the gating signal 67. Therefore the rise and fall times of the signal 67 and of the signal 68 are random times.

The result of this non synchronous state is shown in the waveform 69, wherein 60A and 60B are the rise and fall times with correct coincident of time between the signals 67 and 68, while the rise time 60C and the fall time 60D are error coincident of timing, between the two signals.

The waveform 69 shows the counting or timing errors of Pulse E1 having fall time error 60D, Pulse E2 having correct coincident of times or no timing errors, Pulse E3 having rise time error 60C and Pulse E4 having dual coincident of times error, shown as timing errors 60C and 60D.

From the above waveform 69 it becomes obvious that the maximum counting or timing error per pulse count is two half cycle values of the clock per pulse as shown in Pulse E4 of waveform 69, or 50%×2 clock pulses duration. In the example of the 100 MHz clock discussed above this will be $0.5\times2\times10^{-8}\times$Sec.=10 nano Sec. Such short time errors can be ignored altogether, and as will be explained later, it is simple to program a range of tolerances for permitting such errors to be ignored.

The counter 11C or 12C shown in FIG. 2D is an up-down counter with a separate preset output 29E and is gated by the envelop signal 20D or 20F that is fed to the gate and control circuit 29 such that a pulse rise resets the counter 29A to zero and starts the up counting, while a pulse fall also resets the counter 29A to zero but starts the down counting. The counter feeds to the respective input terminals 1A and 2A of the CPU 18 of FIG. 1 a positive count number for the duration of the highs of the envelope and a negative count number for the duration of the lows of the envelope.

The CPU 18 that is also fed directly through its input terminals 1 and 2 with the envelope signal and reads directly the details of the envelope, can therefore record the duration of each individual high and low of the envelop signal, the number of highs and lows, the total lows, the total highs and the total length of the unknown code, these along with the counted values of each high and low and the total count or the sum pertaining the unknown coded signal as represented by the envelope. Considering the example of the 100 MHz clock, the counting accuracy of ± one count will be ±10 nsec time unit per pulse, which is insignificant.

Further, while the coded RF signals explained above, which includes also the coded IR signals, are based on two defined states, the high and the low, the RF coded signals can be AM or FM modulated to provide more than two states, similar to the barcode readers that identify multi width bars and intervals or spacings, such as the barcode 65 of FIG. 6B, for reading the full data contained in the barcode. The present invention provides for counting, detecting and defining not only high and low on the basis of the envelope's high and low counts, but also to detect the state of the pulse on the basis of the identified pulse width, such as three states low, mid and high, or such as five states low, mid low, mid, mid high and high to be used.

Moreover the combination of counting the unknown coded signals through the counter 11C or 12C or through the CPU's 18A counting circuit and through the direct feeding of the envelope to the CPU input, enables many combinations for utilizing of the unknown coded signal such as the duration of each high and each low of the envelope, the time duration of each high, each mid and each low state, the sequence of each high, each mid and each low state, the total number of high states, mid states and low states, the total lows duration, total mids duration and total highs duration, the total count of lows, mids and highs, the total counted sum, the absolute total length of the envelope of said unknown code in clock count and in time and the polarity of the envelope and a combination thereof.

The above counted values of said unknown coded envelope of an unknown coded signal are recorded by storing the counting details into the memory 17 of FIG. 1 and FIG. 3. The stored values become the reference for utilizing said unknown coded envelope.

Figure 6C:
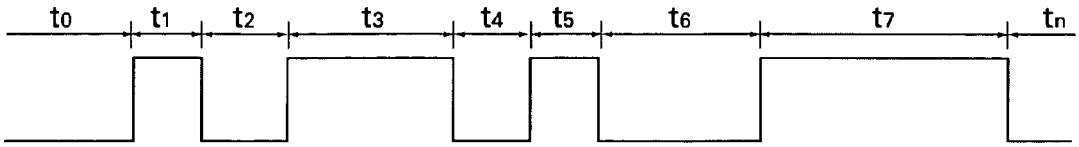
FIG. 6C is a timing chart of the counted waveform of FIG. 5B.

Shown in FIG. 6C is the recording of the principle timing details of the envelope shown in 67 of FIG. 6B. The shown time duration t1, t3, t5 and t7 are the time duration of the envelope highs, while t2, t4 and t6 are the time duration of the envelope lows. The combined envelope time is the sum up of t1~t7, the total sum=t1+t3+t5+t7−t2−t4−t6. The total envelope highs shown is 4 and total envelope lows shown is 3.

Referring to waveform 67 of FIG. 6B and to FIG. 6C it will become clear for example that; E1 and E3 are shown as the narrowest high pulses of the envelope with t1=t5, and therefore can be detected or defined as the high state pulse, the duration of E4 or t7 is shown as the longest, and therefore can be detected or defined as the low state pulse. E2 or t3 is the median duration pulse and thus, can be defined as mid state pulse. Same applies to the lows or the interval times of the envelope, shown as t2, t4 and t6 in FIG. 6C. t2 and t4 are shown as a narrow time and can be detected or defined as shortest low of the envelope, t6 is shown with the longest duration and therefore can be defined as longest low. As shown in the barcode envelope waveform 66 of FIG. 6B, there are several different envelope lows durations, all of which can be detected and defined as short mid, mid or long mid. This extensive data pertaining every detail of the envelope signals along with the ability to define multi level of states that are beyond the two binary states of high and lows of the digital signals, makes the recording of the envelope signals very reliable.

The time duration t0 is a non-active state. It is shown in FIG. 6C as low state, but can be high state as well. The t0 should not be calculated into the total sum or total duration of the code. tn is the last counted duration, which exceeds a pre-selected or programmed time duration, such as 10 msec. or 100 msec. Longer time duration of a low or high state will terminate the recording or the counting of a freshly received unknown coded signal. As will be explained later the tn is therefore a fixed time duration that may be calculated into the total sum, or the total duration of the code, or it can be ignored.

During the recording of an unknown coded signal it is necessary to record related items and data associated with or indexed to the recording. This is necessary for all the remote controlled appliances associated with the video interphone or intercom systems used in the house or the apartment. It is also necessary for identifying the particulars for the driver circuits 19R, 19RF, 19D and 19N to output the programmed signals for correctly controlling the different appliances.

Therefore, the indexed recording of the codes for the operation of the appliances, including the appliances locations such as the emergency and other lighting systems to be activated, the operation of air conditioners, kitchen and garden appliances, switching on and off background music (BGM) and its volume and/or the operation of home theater, DVD or VHS recorders and other A/V systems and the like needed to be recorded into the system memory 17S. The code memory 17 and the system memory 17S are shown as a separate memory circuits, but can be combined or partitioned into any well-known memory device, such as flash memory, or into a flash memory that is included in the CPU 18 or 18A.

The apparatus 1 and 1A of FIG. 1 and FIG. 3 for recording and utilizing unknown coded signal of the present invention provides for the use of IR remote control devices 13 the same way it provides for the RF remote control devices 10. For this purpose at least one IR receiver comprising IR pass filter 13F, lens 13L and photo sensing diode 13S, along with demodulator and processing circuit 13 are incorporated in the apparatus for recording and utilizing unknown coded signals 1 and 1A. A filter with a wavelength of 940 nm band is commonly employed for IR remote controls and it is simple to provide an IR sensor, such as photo transistor or pin diode and a filter covering wider band, such as 850 nm~980 nm.

The demodulator 13D for demodulating and processing the received IR signals is similar to said RF demodulators 11D or 12D. The commonly used demodulator circuit 13D is OOK type because the commonly used IR remote control devices are operated on the basis of on-off keying, but any other modulation and demodulation circuits can be employed.

The steps of demodulating, filtering, counting and storing the unknown coded signal generated by an IR remote control device 13 are same as the steps described for the received RF signals. Same steps of processing, counting and storing also applies to an unknown code of an access key, such as magnetic key processed by the reader 14R, or to the directly fed unknown serial or parallel code signals to input 15, all of which are processed and their envelopes are shaped, filtered, counted and stored the same way as described for the received RF or IR signals.

The remote control devices, including such devices as magnetic card or a barcode card, are configured to transmit or to generate via their corresponding readers respectively a complete, whole code. Some types of remote control devices are configured to repeat the transmission of the serial coded signal, others transmit the complete serial code once per each touch of a key. However all the remote control devices transmit a complete coded signal, which commonly starts with a pilot bit, sync bit and/or start bit and ends with an end bit.

The commonly used receivers, readers and the processors for the remote control devices and/or the magnetic, proximity and other keys or cards are pre configured to read and accept only incoming coded signals that precisely match the pre configured codes, the timing of the pulses, the pulses duration and the precise start bit, the address data, command data and other exclusively configured programs to ensure that only an exclusive pre configured and pre programmed match can access the appliance and/or the system.

Shown in FIG. 6B is a bar code 65 of a well known barcode standard, in which the width of the bars, the spacing between the bars, the number of bars and the width of the spacing are preprogrammed data for pre-configured access. The two shown narrow bars 65A and 65B at the left side of the bar 65 are the start bars or the start bit shown in 66 and the two narrow bars 65C and 65D are the end bars or end bits shown in 66. Accordingly, the barcode reader will not process the bar code unless the start bits and end bits are correctly read.

In contrast, the present invention provides for the use of any such remote control devices, for example, elderly people may use emergency remote control device such as bracelet, charm, pendant or button for transmitting RF or IR signals during emergency, while others may use cards, tags or strip with mechanical code, magnetic code, bar code, or other optical code. The remote control devices may further include such devices as magnetic keys, barcodes, proximity keys, RFID contact less card and other devices by recording the complete unknown coded signals generated by the device or its reader, including such pulse items as pilot, sync, start bit and end bit, all of which become leading pulses and ending pulses within the unknown recorded signals, stored into said memory.

Therefore, for the counting process of the present invention there is no need for pilot bit, sync bit or start bit to initiate the counting process, and the counter starts its counting whenever its gate input is fed with a rise or a fall in the envelope signal fed to it. For ending the counting and/or for completing the counting process of the received signal the counter is programmed to reset itself and stop counting whenever the high or low state remains for a longer duration than "n" milli seconds.

The counter 11C or 12C, shown in FIG. 2D incorporate a preset setting selector 29F for selecting a preset time duration count, or for selecting a preset clock count, representing time duration, for example 10,000 clock pulses count of 100 MHz clock is equal to 0.1 milli sec. The example counter 11C or 12C is designed to stop counting when the preset number is reached and change the state of preset out 29E from low to high, but can be also from high to low. The preset out is fed to the gate and control circuit 29 for resetting the counter 29A through the reset line to zero and to stop the counting by switching the on-off line to off state. By this the counter 11C or 12C is reset to its "ready for counting" state, awaiting next fed rise or fall time of a signal fed to its gate input 29B. As the signal is fed the gate switches its on-off command line to on state and its up-down command line in accordance to the rise or fall state of the received signal. This arrangement of the counting process provides for repetitious counting of the unknown coded signal without errors.

The resetting of the counter 11C, 12C, 13C, 14C or 15C also provide for resetting the system's CPU 18 or 18A into its receiving state and for enabling the receiving of a freshly transmitted unknown coded signal. It is simple to configure the "n" duration, for example, when the slowest rate possible of the unknown code signal is 1 kbit/sec., the width of each low and/or high state of the envelope signal cannot practically exceed 1 milli second duration, therefore "n" duration of longer than, for example, 10 millisecond or 100 milliseconds can be safely configured as an error free end of the transmission, or to identify no transmission state and therefore, provide for the counter to reset itself and the resetting of the CPU to its "receiving ready" state, readying the system for the next fresh receiving.

As the gate input 29B is sensitive to rise and fall times of the signal fed to it and therefore, it is sensitive to random noises, particularly high frequency noises, and moreover, to a noisy unknown coded signal that may reach the gate input 29B because of weak RF reception, such as may be caused by use of the remote control devices 10 from far distance, generating noisy fed signal 20E shown in FIG. 2C. Therefore, the signals fed to the counter 11C, 12C and the counters 13C, 14C and 15C and/or to the CPU 18 of FIG. 1 and 18A of FIG. 3, need to be processed and filtered through a LPF circuit such as 27B shown in FIG. 2C or other type of well known filters, amplified and clipped and/or clamped as explained, in order to output clean, sharp edged envelope signal such as the signal 20F shown in FIG. 2C.

Figure 5A:
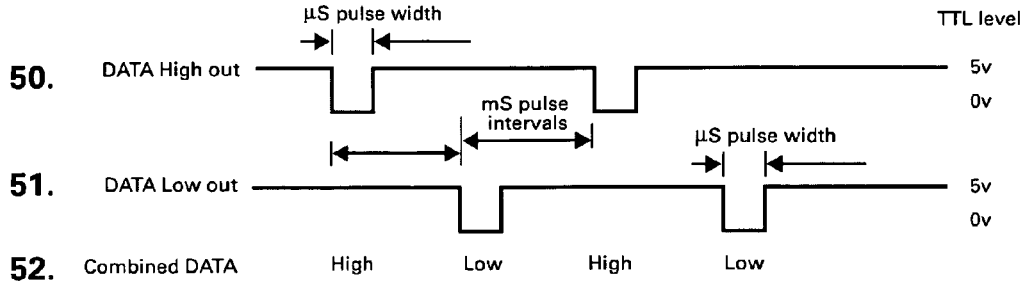
FIGS. 5A~5C are well known waveforms, processed, used and transmitted by access control devices and IR remote control devices.
Figure 5B:
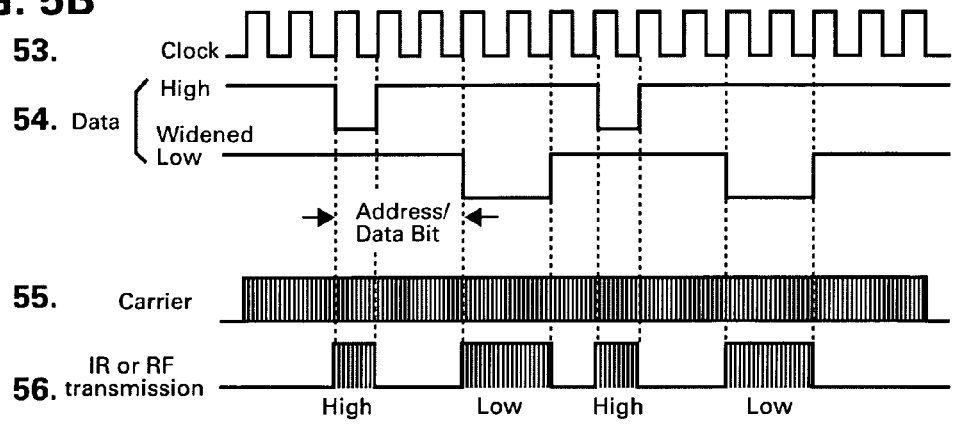

Some remote control systems such as systems using access readers for contact less keys, including proximity keys or RFID devices, employ communication lines that propagate the data lows and the data highs of the coded signals via two separate drivers as shown in FIG. 2A. The reversed polarity pulses 20 and 20A are the high data pulses and the low data pulses. To use such propagated data signals with the present invention for recording and utilizing unknown coded signal the data lows and data highs must be combined into a single input however, the width of the low 20A and the high 20 data pulses is same and the time interval between the pulses is identical. Shown in FIG. 5A are the details of the data high out 50 and the data low out 51 and wherein the pulse width in micro seconds and pulse interval in milli seconds are identical for the low and the high data pulses. The reading of the combined data shown in 52 is only possible with the two separated outputs. This prevents the combining of the data low and high in their present form into a serial code via a single line, as there will be no difference between the low data and the high data pulses.

To overcome this and similar confusing data signals, having identical pulses for the high and the low state, the low data line is fed to an input of the well known mono stable 23 shown in FIG. 2A that generates for each received pulse a single pulse with pre selected width, for widening, for example, the pulse width of the low data and outputting wider low data pulse 20C. Having two different pulse widths for the low and the high data makes it possible to combine the two separate lines into one. As shown in FIG. 2A the high data is directly fed to the input 24B of the OR gate 24 and the low data line with the wider data pulses are fed to the input 24A of the OR gate 24. By this the two data lines are gated one after the other and combined into one serial code outputted from the output 25 of the or gate.

The serial code 20D is inverted signal for providing unified processing for all the received unknown coded signals and for this purpose the OR gate 24 shown in FIG. 2A is an inverting OR gate. However this inversion of the unknown coded signal is not necessary and non-inverting OR gate can be used instead. The shown circuit in FIG. 2A is not necessary when the two separate input lines are fed directly into the CPU 18 or 18A and the CPU is programmed to output a serial signal 20D, in which case the mono stable 23 and the inverting or gate 24 are unnecessary and are not used.

Therefore, an unknown parallel or serially coded outputs can be fed to the counter 14C or 15C and/or to the CPU 18 or 18A, while the storing of the received unknown coded signal, such as shown in FIG. 2A or FIG. 2B, is processed in the same way as described for the data generated by the RF or IR remote control devices.

Figure 5C:
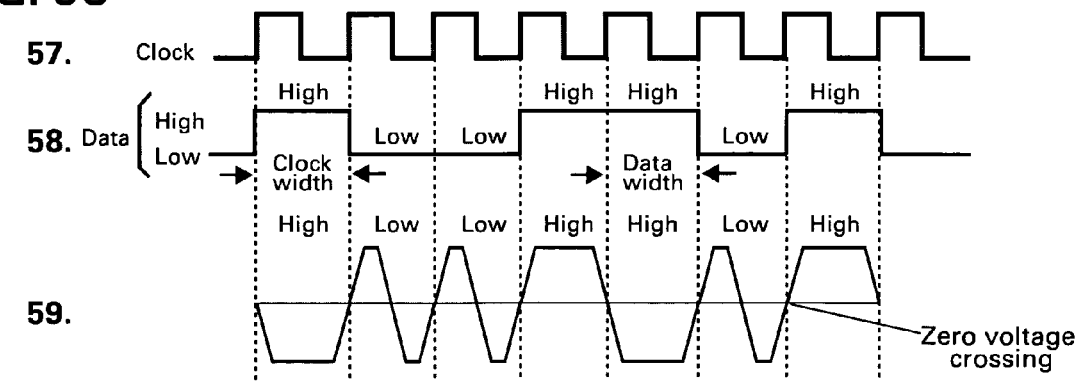

Another example of a modulated or encoded unknown code signal is the well-known FM-0 data signal shown in FIG. 5C. The FM-0 modulated or encoded signal is synchronized with the clock 57 and timed by the synchronous data signal 58 to generate the waveform 59 and is used in access control and security systems network for connecting to access control readers and alarm devices. Accordingly a demodulator or decoder for demodulating or decoding the FM-0 modulated unknown coded signal can be included in apparatus 1 or 1A of FIG. 1 and FIG. 3 respectively. The decoder for the FM-0, not shown, is commonly available in a single package IC at low cost. By the inclusion of FM-0 demodulator or decoder to the processor/decoder and shaper circuit 14D or 15D makes the apparatus 1 or 1A of FIG. 1 and FIG. 3 more flexible for connecting variety of access devices of a buildings and homes to the video interphone system to be used by tenants to arm or disarm their alarm system and switch on the lighting automatically as they enter their home, or manually through the video interphone monitor's or the shopping terminal's keys 255 or the touch screen 244A shown in FIG. 8 and FIG. 10 respectively.

Some type of readers generate and output parallel data, which also cannot be processed by the apparatus 1 or 1A as is, for this purpose it is possible to include a well known parallel to serial code converter 26 as shown in FIG. 2B for the processing circuits 14D or 15D of FIG. 1 and FIG. 3. The parallel to serial converter is commonly available in a single chip IC at low cost and it provides for inputting parallel high and low data through its input terminals 26A, 26B, 26C and 26D and outputting a serial code 20D through its output terminal 27. By this the apparatus 1 and 1A of the present invention becomes even more flexible apparatus for recording and utilizing unknown coded signals of remote control devices.

It is preferable that the RF and IR remote control devices are equipped with multiple touch keys 11K or 13K shown in FIG. 1 and FIG. 3 such as numeric keys, for example, enabling the user to operate appliances, such as a parking barrier by keying a programmed password through the touch keys 11K or 13K of the remote control device 11 or 13. A limitation for multiple keying of unknown coded signals will therefore be the time spacing or interval between the keying, which must be longer than said "n" time duration. As the "n" time duration is a fraction of a second, such as between 10 milli second and 100 milli second, such short time duration does not prevent in any practical way the multiple keying of a password via said keys 11K or 13K of said remote control device 11 or 13.

Figure 8:
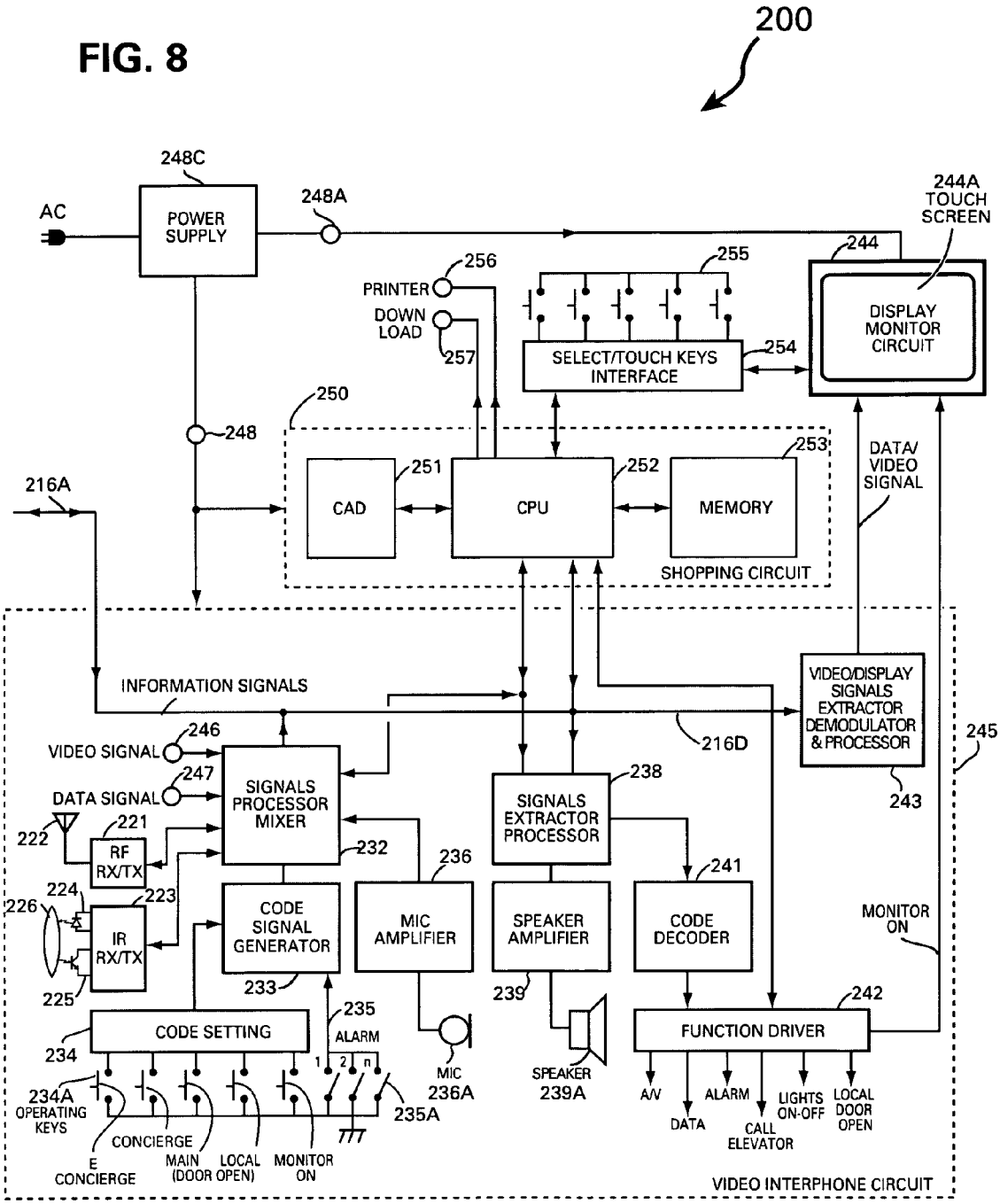
FIG. 8 is a block diagram of a shopping terminal of the preferred embodiment.

The sequence of the keying of a password, for example such as 3-1-4-2, will be the counted values of the four individual envelopes in sequence of 3-1-4-2 that are recorded individually, one after another into the memory 17, for which the CPU 18 or 18A is programmed to record the four separate envelope counts individually and in the keyed sequence and to regenerate the signals in sequence as recorded, for enabling the activation or deactivation of said appliances and/or of said systems through a single operating key 255 or the touch screen 244A of the shopping terminal 200 shown in FIG. 8.

Other programs can be devised to provide tolerances for permitting pre-configured errors in the recording and regenerating processes, such as for permitting counting errors due to rise and fall times, this is to prevent insignificant errors from disturbing the remote control of appliances by the system.

A well known video interphone system described in details in U.S. Pat. Nos. 5,923,363, 6,603,842 and 6,940,957, and the shopping terminal disclosed in U.S. patent application Ser. No. 10/864,311 dated Jun. 8, 2004 employ LCD or other display device and control keys, including such control keys as the well known touch screen, wherein the user touches an illustrated buttons or icons, displayed on the monitor screen for operating a selected appliance. The above referenced patents disclose in detail the operation of the video interphones and the shopping terminal, along with the IR or RF receivers and transmitters and other drivers they use for operating appliances and which are incorporated here by reference.

Figure 7:
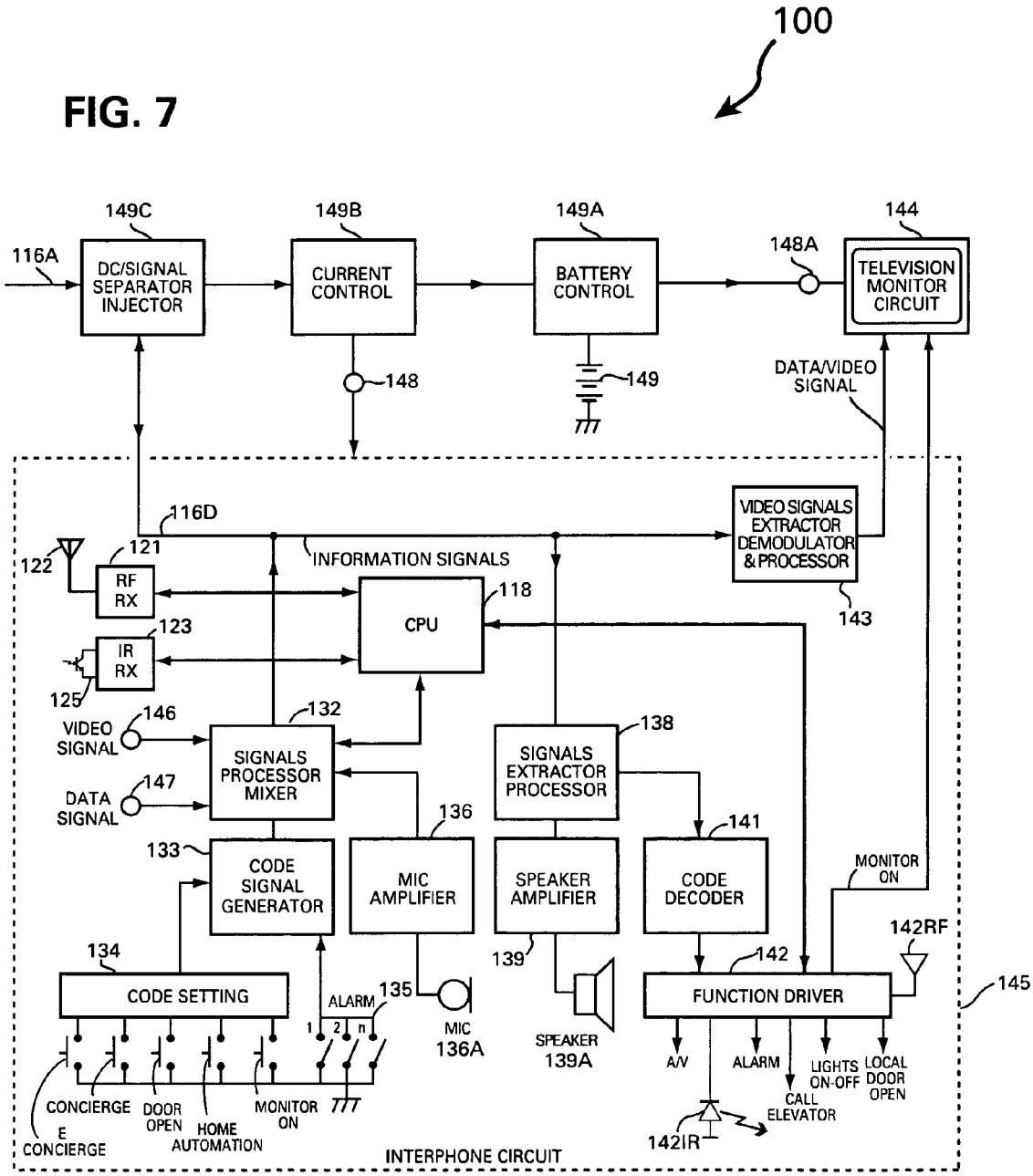
FIG. 7 is a block diagram of a television interphone monitor of the preferred embodiment wherein the television interphone monitor is powered via the information transmission line and includes rechargeable battery.

Shown in FIG. 7 is a video interphone 140 including code setting circuit 134 and data signal input 147 for processing data, such as the serial or parallel data input 15 of FIG. 1. The video interphone also incorporate function driver 142 for operating electrical appliances, such as lights on-off, similar to the driver 19D or driver 19N of FIG. 1.

Shown in FIG. 8 is a shopping terminal 150A combining shopping circuit 150 and video interphone circuit 145. The shopping circuit includes CPU 152 and a memory 153, which are similar to the CPU 18 or 18A and the combined memory 17 and 17S. The shopping terminal 150A further combines a touch screen 144A attached to the display monitor 144 and operating keys 155 and a touch screen interface 154, for processing and operating the touch screen of the shopping terminal 150A combined with the video interphone 145.

The video interphone circuit 145 includes wireless or RF RX/TX (receiver/transmitter) 121, similar to the wireless or RF receivers 11R or 12R and including RF driver 19RF of FIG. 1 and FIG. 3. The IR RX/TX 123 of FIG. 8 is also similar to the IR receiver 13S and the IR driver 19R of FIG. 1. The details of the RF RX/TX circuit 121 and the IR RX/TX circuit 123 are fully described in the U.S. patent application Ser. No. 10/864/311, which are incorporated hereby reference, but are essentially identical to the detailed explanation of the RF receiver 11R, the RF driver 19RF, the IR receiver 13S and the IR driver 19R is this application.

A single RF driver 19RF incorporated in the video interphone 100 or the shopping terminal 200 can propagate wireless remote control commands to any of the appliances that are remotely operated by RF signal. In very large homes or apartments where the low power RF signal cannot reach all the rooms, it is possible to connect to the video interphone system several RF drivers that are installed in different locations within the house, or in the vicinities of the respective appliances.

The CPU 18 of FIG. 1, the CPU 18A of FIG. 3 and the CPU 152 of FIG. 8 can be a well known microprocessor used for PC such as the well known Pentium by Intel and other microprocessors, or it can be a well known digital signal processor, also known as DSP device, or it can be well known custom programmed gate array or similar custom programmed devices. As explained below, it is preferable to use a single package CPU 18A of FIG. 3 consuming low power and includes a memory 17 and 17S, such as flash memory. Such single package CPU can be incorporated in a relay station apparatus of the present invention, shown in FIGS. 9A, 9B, 9C and 9D, which provides for propagating wireless control commands throughout the home or the apartment.

The IR driver 19R comprises a well known driver amplifier, not shown, and IR generator/transmitter 19*r*, which is IR LED driven by the driver amplifier. The IR transmitter or the LED 19*r* must be visually directed toward the IR remotely controlled appliance. For this reason it may be necessary to install a remote IR drivers 19R having wide angle LED 19*r* onto a wall or the ceiling in each room of a house, or IR drivers 19 with specific visual angle directed toward a specific remotely controlled appliance. The RF or IR drivers can be therefore connected via a communication line or lines to the video interphone system, such as the lines connected to the out terminals 1~n of the CPU 18 or 18A of FIG. 1 and FIG. 3 and fed with control commands by the CPU on the basis of the stored and indexed codes for generating wireless, RF or IR control codes to the respective appliances.

The RF driver 19RF, similar to the RF receiver 11R is readily available in a low cost single IC package, consuming minimal current of micro amperes and can be operated by a small size battery for long periods, particularly as it is operated for short durations needed to generate and transmit the low power RF control commands. In fact many RF transceivers (receiver and transmitter) packaged into single IC are readily available at lowcost. Therefore the use of such single packaged transceiver IC along with a single package low current consuming CPU 18B including a memory, transforms the transceiver into RF relay station 1RF shown in FIG. 9A for relaying the wireless control commands received from the video interphone monitor 100 or from the shopping terminal 200 to different locations within the house. Such RF relay station offers many advantages because it provides wide coverage in the house at low cost and with no wiring.

Figure 9A:
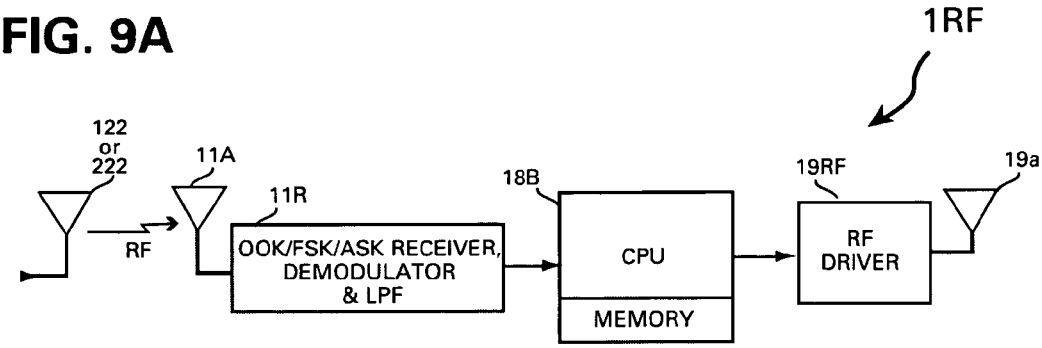
FIG. 9A is a block diagram of a wireless relay station for propagating RF control signal of the preferred embodiment of the present invention.
Figure 9B:
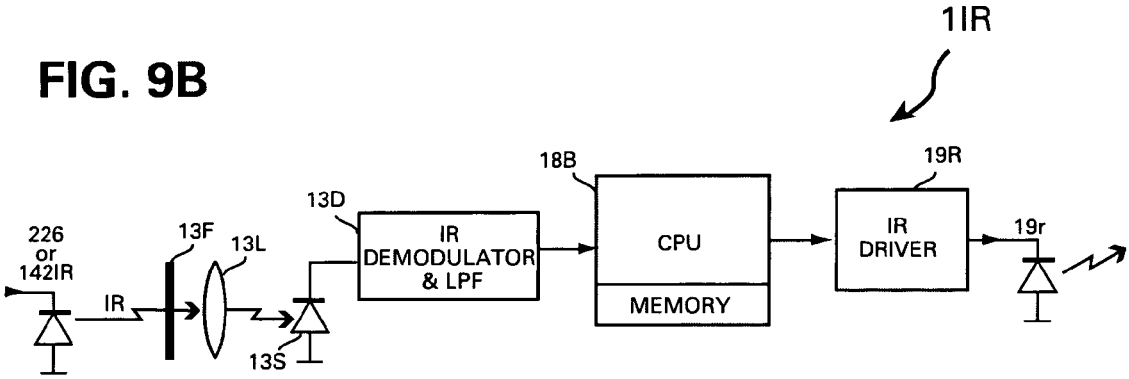
FIG. 9B is a block diagram of wireless relay station for propagating IR control signals of the preferred embodiment of the present invention.

Similarly the IR relay station 11R shown in FIG. 9B provides for receiving IR commands from the video interphone monitor 100 or from the shopping terminal 200 directly through a visual path and relays the control command through another visual path or angle to a given appliance in the home or the apartment.

Figure 9C:
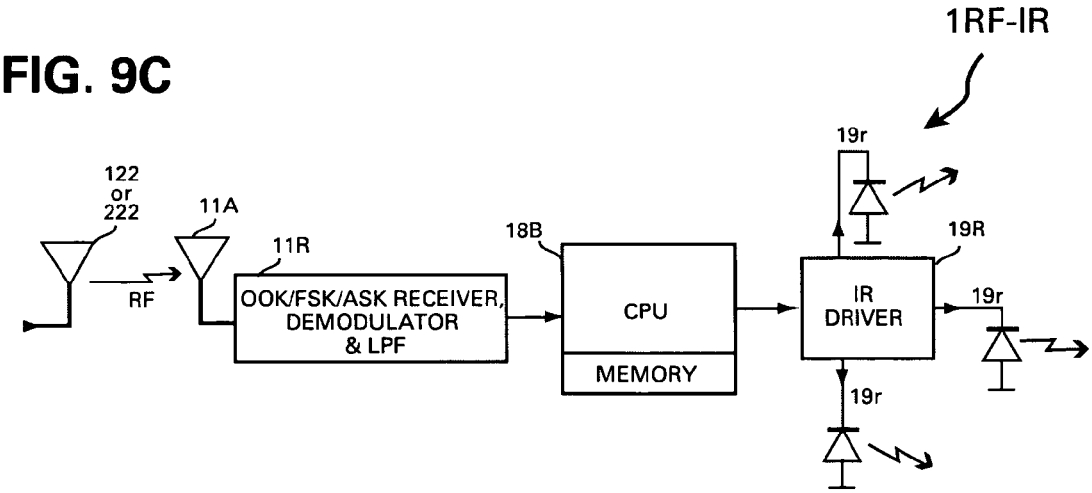
FIG. 9C is a block diagram of wireless relay station for converting RF control signals to IR control signals of preferred embodiment of the present invention.

The IR relay station 1RF-IR shown in FIG. 9C receives RF control commands from the video interphone 100 or the shopping terminal 200, converts the received indexed RF command to an IR coded command via the CPU 18B and generated IR remote control signals via the LEDs 19*r*. Shown in FIG. 9C are three LEDs 19*r*, each transmits its IR signal into different direction. The driver 19R may therefore be equipped with several LEDs 19*r* for covering the whole surrounding area, or may incorporate one, two or a given number of LEDs 19*r* for covering a specific area or location, and/or for mounting on walls, poles, ceiling and the like, or such LEDs 19*r* may be provided with flexible direction adjustment, for adjusting the direction of the one or more employed LEDs.

Figure 9D:
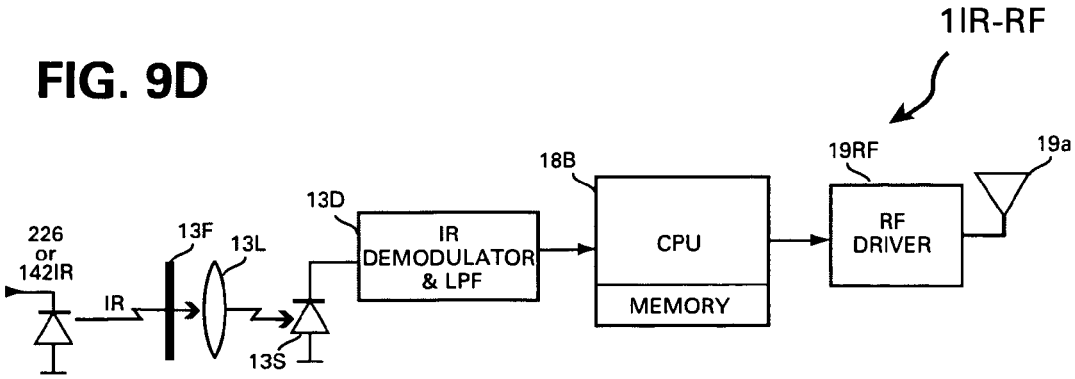
FIG. 9D is a block diagram of wireless relay station for converting IR control signals to RF control signals of preferred embodiment of the present invention.

By this a video interphone or a shopping terminal apparatus of the present invention does not need to be wired to a remote driver, but can be operated through a single wireless RF driver of the video interphone or the shopping terminal, such as the driver 19RF of FIG. 1 and FIG. 3 and the shown driver 221 in FIG. 8 and by the IR driver 19R or 224 for feeding IR control signals to a relay station 1IR-RF shown in FIG. 9D, for receiving IR control signal and regenerating RF control signal.

From the above explanation it becomes clear that a video interphone monitor 100 and a shopping terminal 200 shown in FIG. 7 and FIG. 8 can be used for propagating wireless or wired remote control commands for operating appliances within the homes, apartments and buildings.

The remote controlling of the appliances can be made simple and/or programmed to the individual homeowner preferences. For example, the homeowner can create a command to open the parking barrier by a single button, even though the remote control device for the parking barrier calls for keying a password, referred to above.

Figure 10:
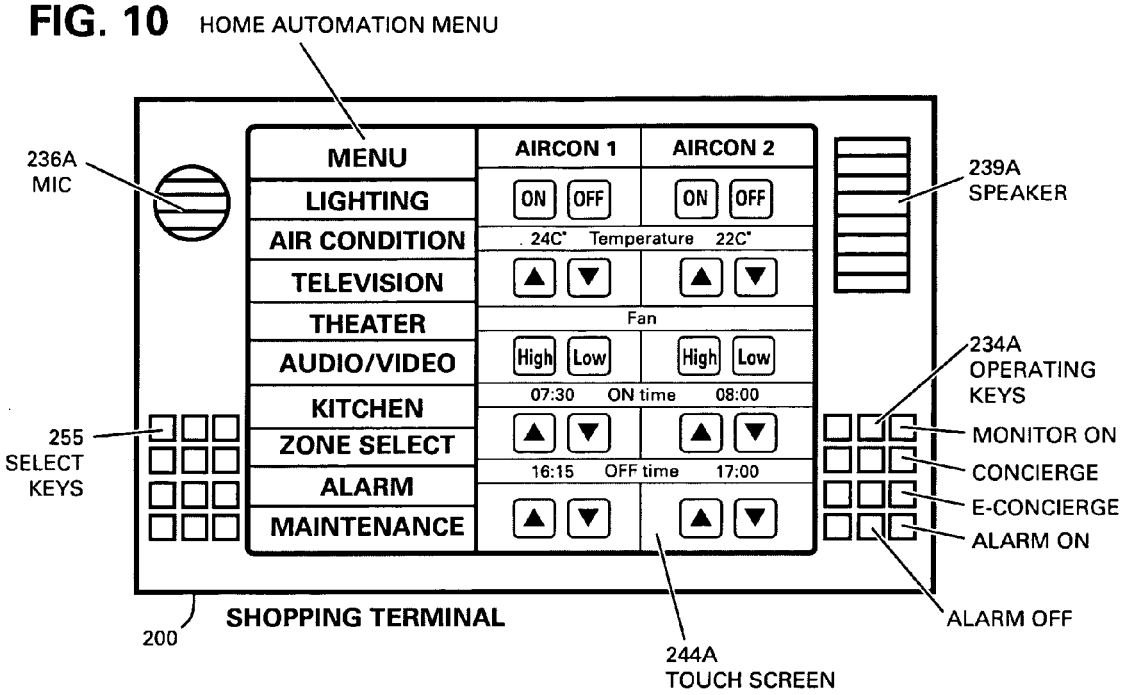
FIG. 10 is an illustration of a television interphone monitor or a shopping terminal of the preferred embodiment with touch screen operation.
Figure 10:
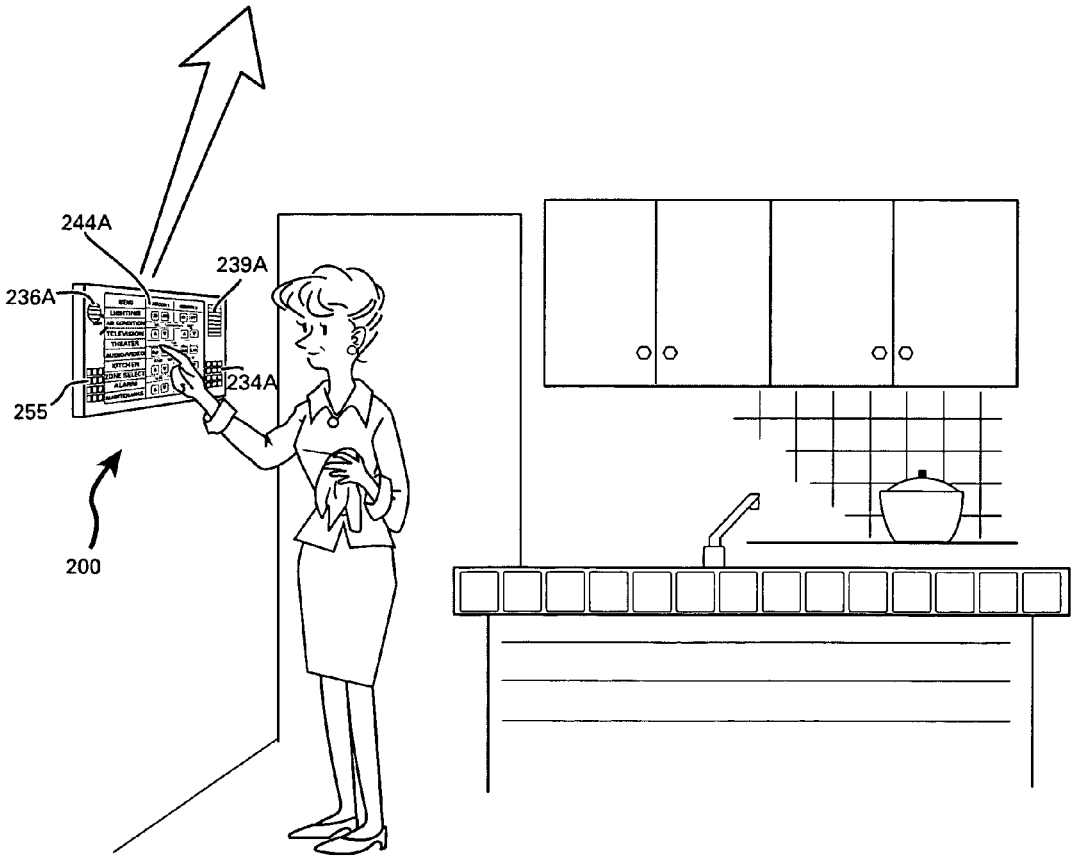

The most convenient way to operate the appliances of the home or the apartment is to provide touch screen displays such as the touch screen 144A shown in FIG. 10, for each appliances or group of appliances, such as displaying touch screen menu under the heading AIR CONDITION, with sub menus listing the individual rooms or zones inside the home, with each room or zone includes ON-OFF icons, cold-hot icons, fan-high fan-low icons and temperature up-down adjust icons.

Similar menus for A/V or curtains or lighting control, with rooms or zones displayed on the monitor screen include icons for audio or video channel select, volume up-down, lights on-off and light dimming up-down, and/or such icons as for programmed preset of BGM (back ground music) in given zones or rooms, including lights and air condition all to be recalled via a single preset icons. It is similarly possible to provide several preset recall icons for morning, day, evening and night time, enabling the home owner to set all its appliances, lights, air condition, activate the alarm and etc, via a single touch of a preset icon, displayed on the monitor screen of his video interphone or shopping terminal apparatus of the present invention.

By programming the CPU 118 of the video interphone 100 or the CPU 252 of the shopping terminal 200 to compare a freshly received remote control signal with the recorded and indexed codes, it is possible to use the original remote control device 11 or 13 for operating the appliances through the video interphones or the shopping terminals. This enables the user, for example, to shut down the air condition in the living room from the master bedroom through the video interphone 100, by using the original IR remote control device of the air condition unit.

Such programming provide for the indexed recording of the counting details of said unknown coded envelope, to be compared with the receiving, decoding and counting of the envelope of a repeat fresh transmission, generated by said remote control device 11 or 13, for remotely controlling of a selected appliance. Wherein once the newly received, decoded and counted envelope is compared with the stored values of said unknown coded envelope and when both values, the freshly counted values and the stored values match, the CPU 18 of FIG. 1 and 18A of FIG. 3 will regenerate the remote control command through the drive circuit 19R, 19RF, 19D or 19N to the corresponding appliance as indexed and recorded in the memory 17S.

Similarly, it is possible to use, for example a proximity key, to activate the drive circuits 19D or 19N, which may include a relay or other hard wire driver circuit, such as open collector, for opening doors or for opening or closing motorized curtains, or for raising parking barrier and/or activating a buffer circuit for feeding serial or parallel codes, known as protocols, for recalling or providing an access to a selected elevator in the lobby or to any selected floor and/or for disarming the alarm system and/or the emergency system and/or for illuminating the entrance lobby of a building.

The recording process of the unknown coded remote control signals into the video interphone 100 and the shopping terminal 200 can be made simple and easy. It can combine steps for verifying the recording, such as, by repeat checking of each and every remote control command and for assigning the icons to a given remote control device 11, and to its operated appliance, in any of the rooms or the zones of the home, apartment or building. The recording is processed with the remote control device 11 or 13 is operated against the video interphone 180 or the shopping terminal 200.

A substantial advantage is the ability to operating the RF remote control device 11 at a close range or visually directing the IR remote control device 13 toward the video interphone 100 or the shopping terminal 200 from a short distance, ensuring that a high signal level with low noise is received by the RF 11R or IR 13S receivers.

Shown in FIG. 10 the touch screen 244A is programmed with different touch keys, for operating variety of appliances, such as home theater, A/V appliances, BGM, aircondition, lighting, alarm, kitchen and laundry appliances, garden appliances, and other electrical appliances. It is preferable and practical to provide basic operating keys, too many touch icons or select keys 255 may unnecessarily complicate the controlling of the home automation, however the program can provide for any number of keys or icons for user preference and selection.

It is necessary and practical to provide keys or touch keys (icons) for switching the appliance on and off, dim the light to a given level, control the temperature and the fan of the air conditioners, select a channel of the A/V or home theater and set the volume. It is also practical to control the F.F, rewind, record, play back of audio and/or video recorder. Similarly it is advantageous to program a preset recall of whole functions, involving more than one appliance at a single touch of key. Another programming is the auto recall of appliances operating mode, such as recalling elevator to a preselected floor, releasing the user from going through the process of selecting the elevator and the floor each time he access the building, or such as switching on preselected lights when the main door to the home is opened.

With the recording of all needed key functions for each appliance in the home completed, it is possible to load the entire program or portion of the program into any or all of the relay stations such as the 1RF, 1IR, 1RF-IR and 1IR-RF and drivers, using wireless or wired connections for transmitting the entire program from the CPU through any of the drivers 19R, 19RF, 19D and 19N. Similarly it is possible to load the program or portion of it to a plurality of video interphones 100 or shopping terminals 200 that are installed a given home or apartment.

With the remote control key functions recorded, it is not necessary to retransmit the entire recorded unknown code between the video interphone or the shopping terminal and the relay station. The transmitting of the index code is sufficient, because the relay station is transmitting to the appliance the remote control signal in accordance with the stored command on the basis of the received index code.

Because the remote control signals, wireless or wired are fed by the video interphone 100 or the shopping terminal 200 apparatus, on the basis of the recorded unknown remote control code's envelopes, which are all indexed and are retrieved through the operating keys 155 or the touch screen 144A of FIG. 8 it becomes clear that the use of the video interphone 100 or the shopping terminal 200 can efficiently provide for operating remotely the appliances within homes, apartments or buildings.

Moreover, because the unknown remote control codes are recorded, stored and indexed into the memories of the video interphone 100, the shopping terminal 200 and the relay stations 1RF, 11R, 1RF-IR and 1IR-RF the remote controlling of appliances can be propagated to anywhere within the home, apartment or the building at low cost and efficiently.

It should be understood, of course, that the foregoing disclosure relates to only a preferred embodiment of the invention and that it is intended to cover all changes and modifications of the example of the invention herein chosen for the purpose of the disclosure, which modifications do not constitute departures from the spirit and scope of the invention.

What is claimed is:

1. A method for recalling an indexed mixed data by a recall selected from a group comprising an automation program, built-in keys in a controller, associated keys of at least one remote recall unit and combinations thereof for operating at least one specific function of at least one specific appliance of a plurality of remote controlled appliances within a premises through a network of at least one driver of at least one output of said controller selected from the group comprising of a video interphone, a shopping terminal, a dedicated control station and combinations thereof;

each of said indexed mixed data is a sequence of a data comprising a specific premises data pertaining to said at least one specific appliance, said at least one specific appliance location, said driver and a specific command data of a remote control signal used for operating said specific function, selected from one of a single remote control signal and a sequence of remote control signals, is stored in a memory of said controller, said recalling addresses a specific index of said mixed data for initiating a reproduction and propagation of a specific remote control signal via said output to said at least one specific appliance, said controller further including at least one input for receiving said remote control signal and a central processing unit, said method comprising the steps of:

creating said premises data on the basis of said at least one driver, said appliances, each said appliances type and its location including each said specific premises data;

feeding said remote control signal used for each of a desired function for each of said plurality of remote controlled appliances including said remote control signal for operating said at least one specific function of said at least one specific appliance to said input;

filtering each received said remote control signal for feeding its envelope to said central processing unit;

creating said command data pertaining to each said desired function including said specific command data by said central processing unit processing each said envelope:

uniquely mixing said specific premises data with said specific command data and indexing each said uniquely mixed data into one said specific index of said mixed data stored in said memory;

assigning said recalling of said specific index to said automation program and to at least one key of said keys; and engaging one of said automation program and said key for said recalling of said specific index for propagating a reproduced said specific remote control signal to said at least one specific appliance in said specific location.

2. The method for recalling an indexed mixed data according to claim 1 wherein said built-in keys are forming an integral part of said control station and said associated keys communicate with said control station via a network selected from the group comprising a wireless network, an RF network, an IR network, an optical network, a wired network, a data network and combinations thereof.

3. The method for recalling an indexed mixed data according to claim 1 wherein said keys are selected from the group comprising a touch switch, a push switch, a key switch, a micro switch, a key pad, a toggle switch, a slide switch, an electronic switch, a mechanical switch, a magnetic switch, an optical switch, a proximity switch, a magnetic reader, an RFID reader, a card reader, an optical reader, a touch screen icon, a touch screen menu, a touch screen line, a touch screen zone, a touch screen area, the whole of a touch screen and combinations thereof.

4. The method for recalling an indexed mixed data according to claim 1, wherein said input is selected from the group comprising a wireless receiver, an RF receiver, an IR receiver, an optical receiver, a wired receiver, a data receiver and combinations thereof and said output is a driver output circuit selected from the group comprising a relay contact, an open collector, an electronic switch, an electric switch, a serial code buffer, a parallel code buffer, an RF transmitter, an IR transmitter, an optical transmitter and combinations thereof.

5. The method for recalling an indexed mixed data according to claim 1, wherein said appliance is selected from the group comprising at least one of an alarm sensor an alarm device, an alarm controller, an emergency sensor, an emergency device, an emergency equipment, the elderly support equipment, the handicap support equipment, a medical sensor, medical equipment, a lighting device, a light switch, a light fixture, a television receiver, an audio-visual recorder, a radio, a back ground music system, a home theater, an audio-video playback device, audio system, a motorized curtain, a motorized blind, a motorized shade, an electric lock, a kitchen utensil, a kitchen equipment, a laundry machine, a laundry dryer, a garden equipment, a garden system, an air conditioner, an air pollution controller, an air pollution filter, an oven, a refrigerator, a freezer, a heating system, a cooling system, an environmental sensor, an environmental controller, a power consumption sensor, an energy control device, an energy controller, a motorized garage door, a parking barrier, an elevator and combinations thereof.

6. The method for recalling an indexed mixed data according to claim 1, wherein said processing is selected from the group comprising detecting frequency, detecting rise time, detecting fall time, detecting time duration, detecting pulse width, detecting pulse level, detecting interval width, pulses counting, intervals counting, defining pulses state, defining intervals state, resetting and combinations thereof.

7. The method for recalling an indexed mixed data according to claim 1, wherein said specific command data is a sequence of commands and wherein a single engagement of one of said automation program and said key recalls a sequence of said remote control signals.

8. The method for recalling an indexed mixed data according to claim 7, wherein said single engagement recalls a sequence of a repeated said specific remote control signal.

9. The method for recalling an indexed mixed data according to claim 4, wherein said RF receiver detects the frequency of a received RF signal and said IR receiver detects the clock frequency of a received IR signal.

10. The method for recalling an indexed mixed data according to claim 4, wherein the frequency of said RF transmitter is controlled by said RF receiver and the clock frequency of said IR transmitter is controlled by one of said IR receiver and said central processing unit.

11. The method for recalling an indexed mixed data according to claim 4, wherein each said output selected from the group comprising a relay contact, an open collector, an electronic switch and an electric switch directly connectable to said specific appliance via a wired circuit.

12. The method for recalling an indexed mixed data according to claim 1, wherein said output is selected from the group comprising a serial code buffer, a parallel code buffer, an RF transmitter, an IR transmitter, an IR transmitter, and optical transmitter, a data buffer and combinations thereof for propagating one of said remote control signal and said recalling via at least one of distributed wire network and a remote relay station.

13. The method for recalling an indexed mixed data according to claim 1, wherein software items selected from the group comprising said program, said indexing, said specific indexing, said assigning, said mixed data, said specific mixed data, said premises data, said command data and combinations thereof are propagated between said controller and its associated peripherals selected from a group comprising a distributor for said network, a keypad, an IR remote control unit, an RF remote control unit, a remote driver, a remote relay station and combinations thereof for program handling selected from a group comprising uploading, downloading, reprogramming, updating, modifying and combinations thereof through at least one of said input and said output.

14. The method for recalling an indexed mixed data according to claim 1, wherein said network propagates said remote control signal to at least one relay station selected from the group comprising a serial code to a relay contact station, a serial code to an electric switch station, a serial code to an RF transmitter station, a serial code to an IR transmitter station, a serial code to an optical transmitter station, a parallel code to a relay contact station, a parallel code to an electric switch station, a parallel code to an RF transmitter station, a parallel code to an IR transmitter station, a parallel code to an optical transmitter station, an RF receiver to a relay contact station, an RF receiver to an electric switch station, an RF receiver to an RF transmitter station, an RF receiver to an IR transmitter station, an RF receiver to an optical transmitter station, an IR receiver to a relay contact station, an IR receiver to an electric switch station, an IR receiver to an IR transmitter station, an IR receiver to an optical transmitter station, an IR receiver to an RF transmitter station and combinations thereof.

15. The method for recalling an indexed mixed data according to claim 1, wherein said network of said driver is a distributed network via at least one of a data distributor and a remote control signal distributor.

16. The method for recalling an indexed mixed data according to claim 1, wherein at least one of said indexed mixed data comprising said premises data pertaining to a plurality of appliances in at least one of said specific location and throughout said premises and said specific command data comprising at least one remote control signal for operating a function of said plurality of appliances and wherein said engaging one of said automation and said key propagates a reproduced said specific remote control signal to said plurality of appliances in said at least one specific location and said throughout said premises.

17. An apparatus for recalling an indexed mixed data by a recall selected from a group comprising an automation program, built-in keys in a controller, associated keys of at least one remote recall unit and combinations thereof for operating at least one specific function of at least one specific appliance of a plurality of remote controlled appliances within a premises through a network of at least one driver of at least one output of said controller selected from the group comprising of a video interphone, a shopping terminal, a dedicated control station and combinations thereof;

each of said indexed mixed data is a programmed sequence of a data comprising a specific premises data pertaining to said at least one specific appliance, said at least one specific appliance location, said driver and a specific command data of a remote control signal used for operating said specific function, selected from one of a single remote control signal and a sequence of remote control signals, is stored in a memory of said controller and said recalling addresses a specific index of said mixed data for initiating a reproduction and propagation of a specific remote control signal via said output to said specific appliance;

said controller further including at least one input for receiving and filtering said remote control signal for outputting an envelope of each received said remote control signal to a central processing unit included in said controller, said central processing unit creates said specific command data pertaining to each specific function of each said specific appliance by processing each said envelope and uniquely mixes each said specific command data with said specific premises data;

said automation program and at least one key of said keys are assigned with said recalling of said specific index by engaging one of said automation program and said key for propagating said reproduction of said specific remote control signal via said output to said at least one specific appliance in its said specific location.

18. The apparatus for recalling an indexed mixed data according to claim 17 wherein said built-in keys are forming an integral part of said controller and said associated keys communicate with said control station via a network selected from the group comprising a wireless network, an RF network, an IR network, an optical network, a wired network, a data network and combinations thereof.

19. The apparatus for recalling an indexed mixed data according to claim 17 wherein said keys are selected from the group comprising a touch switch, a push switch, a key switch, a micro switch, a key pad, a toggle switch, a slide switch, an electronic switch, a mechanical switch, a magnetic switch, an optical switch, a proximity switch, a magnetic reader, an RFID reader, a card reader, an optical reader, a touch screen icon, a touch screen menu, a touch screen line, a touch screen zone, a touch screen area, the whole of a touch screen and combinations thereof.

20. The apparatus for recalling an indexed mixed data according to claim 17, wherein said input is selected from the group comprising a wireless receiver, an RF receiver, an IR receiver, an optical receiver, a wired receiver, a data receiver and combinations thereof and said output is a driver output circuit selected from the group comprising of a relay contact, an open collector, an electronic switch, an electric switch, a serial code buffer, a parallel code buffer, an RF transmitter, an IR transmitter, an optical transmitter and combinations thereof.

21. The apparatus for recalling an indexed mixed data according to claim 17, wherein said appliance is selected from the group comprising at least one of alarm sensor an alarm device, an alarm controller, an emergency sensor, an emergency device, an emergence equipment, the elderly support equipment, the handicap support equipment, a medical sensor, a medical equipment, a lighting device, a light switch, a light fixture, a television receiver, an audio-visual recorder, a radio, a back ground music system, a home theater, an audio-video playback device, audio system, a motorized curtain, a motorized blind, a motorized shade, an electric lock, a kitchen utensil, a kitchen equipment, a laundry machine, a laundry dryer, a garden equipment, a garden system, an air conditioner, an air pollution controller, an air pollution filter, an oven, a refrigerator, a freezer, a heating system, a cooling system, an environmental sensor, an environmental controller, a power consumption sensor, an energy control device, an energy controller, a motorized garage door, a parking barrier, an elevator and combinations thereof.

22. The apparatus for recalling an indexed mixed data according to claim 17, wherein said processing is selected from the group comprising detecting frequency, detecting rise time, detecting fall time, detecting time duration, detecting pulse width, detecting pulse level, detecting interval width, pulses counting, intervals counting, defining pulses state, defining intervals state, resetting and combinations thereof.

23. The apparatus for recalling an indexed mixed data according to claim 17, wherein said specific command data is a sequence of commands and wherein a single engaging of one of said automation program and said keys recalls a sequence of said remote control signals.

24. The apparatus for recalling an indexed mixed data according to claim 22, wherein said single engaging recalls a sequence of a repeated said specific remote control signals.

25. The apparatus for recalling an indexed mixed data according to claim 21, wherein said RF receiver detects the frequency of a received RF signal and said IR receiver detects the clock frequency of a received IR signal.

26. The apparatus for recalling an indexed mixed data according to claim 21, wherein the frequency of said RF transmitter is controlled by said RF receiver and the clock frequency of said IR transmitter is controlled by one of said IR receiver and said central processing unit.

27. The apparatus for recalling an indexed mixed data according to claim 21, wherein each said output selected from the group comprising a relay contact, an open collector, an electronic switch and an electric switch is directly connectable to said specific appliance via a wired circuit.

28. The apparatus for recalling an indexed mixed data according to claim 17, wherein said output is selected from the group comprising a serial code buffer, a parallel code buffer, an RF transmitter, an IR transmitter, an optical transmitter, a data buffer, and combinations thereof for propagating one of said remote control signal and said recalling via at least one of a distributed wired network and a remote relay station.

29. The apparatus for recalling an indexed mixed data according to claim 17, wherein software items selected from the group comprising said program, said indexing, said specific indexing, said assigning, said mixed data, said specific mixed data, said premises data, said command data and combinations thereof are propagated between said control station and its associated peripherals selected from a group comprising a distributor for said network, a keypad, an IR remote control unit, an RF remote control unit, a remote driver, a remote relay station, and combinations thereof for program handling selected from a group comprising uploading, downloading, reprogramming, updating, modifying and combinations thereof through at least one of said input and said output.

30. The apparatus for recalling an indexed mixed data according to claim 17, wherein said network propagates said remote control signal to at least one relay station selected from the group comprising a serial code to a relay contact station, a serial code to an electric switch station, a serial code to an RF transmitter station, a serial code to an IR transmitter station, a serial code to an optical transmitter station, a parallel code to a relay contact station, a parallel code to an electric switch station, a parallel code to an RF transmitter station, a parallel code to an IR transmitter station, a parallel code to an optical transmitter station, an RF receiver to a relay contact station, an RF receiver to an electric switch station, an RF receiver to an RF transmitter station, an RF receiver to an IR transmitter station, an RF receiver to an optical transmitter station, an IR receiver to a relay contact station, an IR receiver to an electric switch station, an IR receiver to an IR transmitter station, an IR receiver to an optical transmitter station, an IR receiver to an RF transmitter station and combinations thereof.

31. The apparatus for recalling an indexed mixed data according to claim 17, wherein said network of said driver is a distributed network via at least one of a data distributor and said remote control signal distributor.

32. The apparatus for recalling an indexed mixed data according to claim 17, wherein at least one of said indexed mixed data comprising said premises data pertaining to a plurality of appliances in at least one of said specific location and throughout said premises and said specific command data comprising at least one remote control signal for operating a function of said plurality of appliances and wherein said engaging one of said automation and said key propagates a reproduced said specific remote control signal to said plurality of appliances in said at least one specific location and said throughout said premises.

* * * * *